US008401412B2

(12) United States Patent
Mikutsu

(10) Patent No.: US 8,401,412 B2
(45) Date of Patent: Mar. 19, 2013

(54) CONVEYANCE SPEED DIFFERENCE MAINTAINING HEAT AND PRESSURE FIXING SYSTEM

(75) Inventor: Yasunari Mikutsu, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 579 days.

(21) Appl. No.: 12/724,959

(22) Filed: Mar. 16, 2010

(65) Prior Publication Data

US 2010/0239295 A1 Sep. 23, 2010

(30) Foreign Application Priority Data

Mar. 17, 2009 (JP) ..... 2009-064477
Jun. 3, 2009 (JP) ..... 2009-133863
Jun. 26, 2009 (JP) ..... 2009-152156

(51) Int. Cl.
*G03G 15/00* (2006.01)

(52) U.S. Cl. ..... 399/68
(58) Field of Classification Search ..... 399/68
See application file for complete search history.

(56) References Cited

U.S. PATENT DOCUMENTS 7,664,415 B2 2/2010 Mikutsu

FOREIGN PATENT DOCUMENTS

| | | |
|---|---|---|
| JP | 63-192068 | 8/1988 |
| JP | 10-198099 | 7/1998 |
| JP | 2001-290382 | 10/2001 |
| JP | 3403577 | 2/2003 |
| JP | 2003-167459 | 6/2003 |
| JP | 2005-266659 | 9/2005 |
| JP | 2006-119517 | 5/2006 |
| JP | 2007-17888 | 1/2007 |
| JP | 2007-297195 | 11/2007 |
| JP | 2008-209624 | 9/2008 |
| JP | 4250556 | 1/2009 |

*Primary Examiner* — Walter L Lindsay, Jr.
*Assistant Examiner* — Ruth Labombard
(74) *Attorney, Agent, or Firm* — Oblon, Spivak, McClelland, Maier & Neustadt, L.L.P.

(57) ABSTRACT

A fixing apparatus includes a fixing mechanism having a first motor, and a conveyance mechanism arranged downstream of the fixing mechanism having a second motor. A motor control section is provided to control sheet conveyance speeds V1 and V2 in the respective fixing and conveyance mechanisms to maintain a difference therebetween within a prescribed range by adjusting a number of rotations of one of the first and second motors.

20 Claims, 9 Drawing Sheets

CONVEYANCE SPEED DIFFERENCE MAINTAINING HEAT AND PRESSURE FIXING SYSTEM

CROSS REFERENCE TO THE RELATED APPLICATIONS

This application claims priority under 35 USC §119 to Japanese Patent Application Nos. 2009-064477, 2009-133863, and 2009-152156 filed on Mar. 17, Jun. 3, and Jun. 26, all 2009, respectively, the entire contents of which are herein incorporated by reference.

BACKGROUND OF THE INVENTION

The present invention relates to a heat and pressure type fixing device, and an electrophotographic system employing image forming apparatus, such as a copier, a printer, a facsimile, etc., including the fixing device.

In a conventional color electrophotographic system, a fixing device frequently provides brilliance to an image carried on a sheet similar to that of the background of the sheet.

To increase the brilliance of the image using the color-fixing device, fixing calorie is generally supplied by either increasing a fixing temperature or decreasing a line speed of a sheet of a printing member P. Because, a toner image can be made into a gel state and the toner particle loses its shape. However, when the fixing temperature is increased, heat diffusion from the fixing device increases. When the line speed is decreased, power is increasingly consumed due to a large amount of heat-supply not only to the toner but also the sheet. Such a usage of heat energy for the purpose of smoothing the toner surface is against a recent technical tendency of saving power.

It is known that brilliance highly likely increases as pressure increases at a nip where both the pressure and heat are applied to a sheet in the fixing device.

Thus, to provide the high brilliance, a system of creating a high nip pressure is demanded. As a result, a fixing device becomes bulky especially when improving productivity with the system. In addition, the line speed is decreased to supply a large amount of calorie when the brilliance is applied. Then, the productivity can significantly decrease as a result.

The Japanese Patent Application Laid Open Nos. 63-192068 and 2003-167459 propose a technology capable of controlling the brilliance by selectively using plural fixing devices. Specifically, such fixing devices include nip sections in the respective fixing devices, and convey sheets by primary drive rollers arranged therein. However, sheet jam and/or wrinkle occurs between the fixing devices or the sheet bends therebetween and contacts a guide member, so that an image is disturbed and a quality sometimes deteriorates.

SUMMARY OF THE INVENTION

Accordingly, an object of the present invention is to address and resolve such and other problems and provide a new and novel fixing apparatus. Such a new and novel fixing apparatus comprises a fixing mechanism including a first motor, a first driving roller driven by the first motor pressure contacting a first driven roller, and a first nip formed between the first driving and driven rollers and fixes non-fixed toner carried on a sheet conveyed by the first driving roller.

A conveyance mechanism is arranged downstream of the fixing mechanism and includes a second motor, a second driving roller driven by the second motor contacting a second driven roller, and a second nip formed between the second driving and driven rollers and pinches and conveys the sheet as the second driving roller rotates. A motor control section is provided to control sheet conveyance speeds V1 and V2 in the respective fixing and conveyance mechanisms to maintain a difference therebetween within a prescribed range by adjusting a number of rotations of one of the first and second motors.

In another aspect, the motor control section adjusts the number of rotations based on one of a value of current flowing to one of the first and second motors, electric power supplied to one of the first and second motors, and a value of torque included in an instruction being provided to one of the first and second motors, said value of current, electric power, and value of torque being monitored during an operation of the motor control section.

In yet another aspect, the motor control section adjusts the number of rotations based on surface temperature of one of the first and second driving rollers.

In yet another aspect, the motor control section adjusts the number of rotations based on a loosening amount of the sheet between the fixing and conveyance mechanisms.

In yet another aspect, the conveyance mechanism includes one of a brilliance application section that provides brilliance to the sheet and a second fixing section that further fixes the toner.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENTS OF THE PRESENT INVENTION

Figure 1:
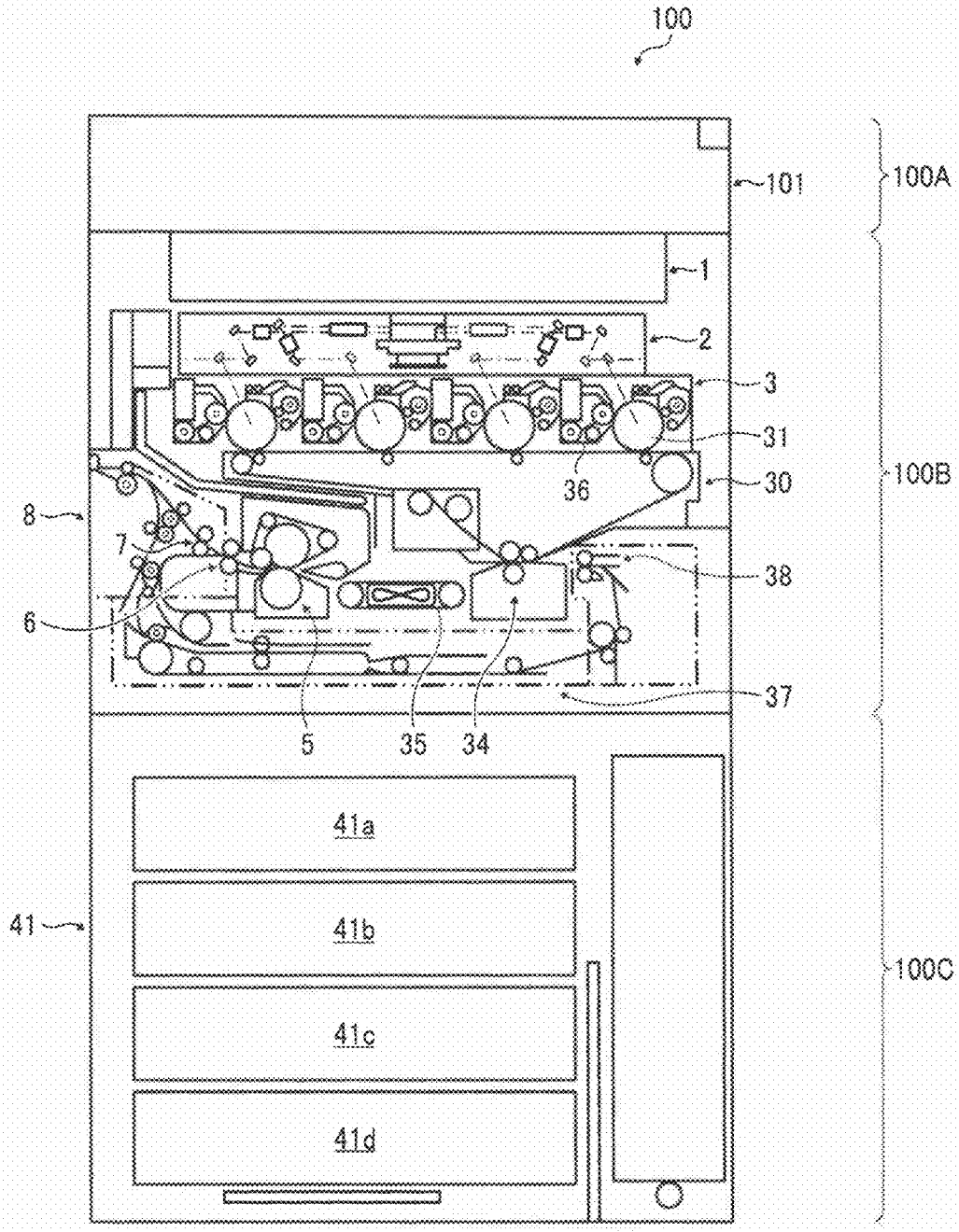
FIG. 1 illustrates the entire configuration of an exemplary image forming apparatus according to one embodiment of the present invention.

Referring now to the drawing, wherein like reference numerals designate identical or corresponding parts throughout several views, in particular in FIG. 1, a digital color copier as one example of an image forming apparatus according to the present invention is described.

The color copier 100 includes an image reading section 100A arranged in the upper section of the apparatus body, an image formation section 200B arrange almost at a center of the apparatus body, and a sheet feeding section 200C arranged in the lower section of the apparatus body.

The image reading section 100A includes a scan section 1 that optically reads image information of an original document, and an ADF (Automatic Document Feeder) 101 that conveys the original documents consecutively to the scan section 1.

In an image formation section 100B, there is arranged a belt type intermediate transfer member 30 having a transfer surface extending horizontally, and plural mechanisms arranged above the intermediate transfer member 30 to form (mono) color images complement to resolution colors.

Specifically, four photoconductive members 31 are arranged side by side along the transfer surface of the intermediate transfer member 30 as image bearers to carry images of complementary colors of Yellow, Magenta, Cyan, and Black, respectively.

Above the photoconductive member 31, there is provided a writing section 2 that emits an exposure light to respective photoconductive members 31 in accordance with scanner or external image information.

Further, the respective photoconductive members 31 are drum types and rotate in the same direction (e.g. counter clockwise). Around the photoconductive member, there are provided a developing section 3 that includes a char device, a developing device, and a primary transfer device for collectively executing image formation as the drum rotates, and a cleaning section 36 that collects toner remaining on the photoconductive member 31 after the transfer process.

The respective developing devices store different color toner.

The intermediate transfer member 30 is wound around driving and driven rollers and movable opposing to the photoconductive members 31 in the same direction.

A secondary transfer section 34 includes a transfer roller and is arranged opposing to one of the driven rollers.

Further, on a path line PL extending from the secondary transfer section 34 for conveying a printing member P, there are provided a conveyance belt 35, a fixing mechanism 5, a brilliance application mechanism 6, and a conveyance roller pair 7 are arranged in this order.

A sheet feeding section 200C includes a sheet feeding tray 41 (formed from pieces of 41*a* to 41*d*) for stacking and accommodating plural sheets of printing member Ps, a conveyance path 37 for separating and conveying the uppermost printing member P one by one stacked on the sheet feeding tray 41 toward the secondary transfer section, and a registration section 38 including a conveyance mechanism for correcting skew and synchronizing the printing member P with image formation.

Thus, to form an image in the image forming apparatus 100, respective surfaces of the photoconductive member 31 are uniformly charged and latent images are formed by the writing section 2 thereon in accordance with scanner image information sent from the image reading section 100A or external image information corresponding to respective mono colors.

These latent images are visualized as toner images by the developing devices storing respective corresponding mono colors, and are transferred onto the intermediate transfer member 30 by the primary transfer devices provided with prescribed biases, respectively.

Thus, respective toner images are transferred and superimposed one after another by electrostatic force on the intermediate transfer member 30.

Then, the toner images on the intermediate transfer member 30 after the primary transfer process are transferred onto the printing member P conveyed to the second transfer section 34. The printing member P with the toner images of a full color is conveyed to the fixing mechanism 5 and the toner images are fused at the fixing nip created by the fixing member and the pressurizing member.

Then, upon need, the fuse toner on the printing member P is provided with brilliance by the brilliance application mechanism 6. The printing member P is then conveyed by the conveyance roller pair 7 and is launched from a sheet ejection section 8 along a sheet ejection path, and is ejected out of the apparatus body as an output image.

Then, a series of image formation processes is completed.

Thus, according to one embodiment of the present invention, sophisticated fixing and brilliance application functions are obtained and various types of printing member Ps (from thin to thick ones) and such images (e.g. brilliance application and non-brilliance) are appropriately handled maintaining high productivity of printing member Ps.

Now, steps after the fixing step executed in the image forming apparatus of FIG. 1 is described with reference to FIG. 2. The image forming apparatus 100 of the present invention includes both modes, in which brilliance is either or not applied to an image.

Specifically, the a fixing mechanism 5 is provided on a path line PL including a ratable fixing member (e.g. a fixing belt 11) and a pressurizing member (e.g. a pressurizing roller 14) pressure contacting the fixing member to create a nip N1 where a toner is fused into a printing member P.

A conveyance mechanism (i.e., a brilliance application mechanism) 6 is also provided thereon including a first rotation member (e.g. a heating roller 80) having a heating device (e.g. a heating member 85) and a second rotation member (e.g. a pressurizing roller 90) pressure contacting the first rotation member to create a nip N2.

Further provided thereon is a conveyance roller pair (conveyance roller pair 7) arranged at a position downstream of the trailing end of the nip of the fixing device within a distance L1 of 210 mm to convey the printing member P.

These provisions are arranged in this order.

In this embodiment, a section from the fixing mechanism 5 to the conveyance mechanism (6) is collectively referred to as a fixing device.

Now, an exemplary fixing mechanism is described.

The fixing mechanism 5 includes a cylindrical fixing roller 12, a separation roller 13, a heating roller 15, a tension roller 16, a fixing belt 11 wound around the rollers 12, 13, 15, and 16 with a prescribed tension, and a pressurizing roller 14 ratably pressure contacting the fixing belt 11 to create a nip N1 between them.

Thus, two nips are created by the pressurizing roller 14 contacting the pressurizing roller 14 and the separation roller 13 via the fixing belt 11 at two positions, respectively. These rollers 11, 12, 13, 15, and 16 are collectively referred to as a fixing belt unit.

Further provided is a separation member 43 on the printing member P ejection side of the nip N1 with its leading end being adjacent to the pressurizing roller 14 to prevent the printing member P from winding up around the pressurizing roller 14.

The fixing belt 11 is endless and fuses a not fixed toner T on the printing member P, and has a laminated construction including a substrate made of, such as nickel, stainless, polyimide, etc., and an elastic layer made of rubber, such as silicone, etc., overlying thereof.

For example, the endless belt 11 includes an internal diameter of 115 mm.

The substrate is made of polyimide resin and is highly heat resistant having a small thermal expansivity with relatively large intensity.

Silicone rubber is then coated on the substrate with a thickness of 200 micrometer.

Further coated on the silicone rubber as the outermost layer is tube state fluorine having fine releasability, such as PFA, etc.

The fixing roller 12 includes a hollow cylindrical substrate roller and a heat resistant layer, such as foam silicone rubber, etc., overlying the substrate roller.

Thus, the outer diameter of the fixing roller 12 may totally be 65 mm with the foam silicone roller of 14 mm overlying the substrate roller.

The separation roller 13 has a smaller outer diameter than that of the fixing roller 12, and includes a metal core and a coat made of fluorine resin or solid rubber overlying the core metal. The separation roller 13 also includes a heat pipe in its axial direction to prevent temperature unevenness.

For example, a roller made of aluminum of 1 mm thickness is coated with fluorine resin, and has an outer diameter of 16 mm. Further, the separation roller 13 is swingable around the axis of the fixing roller 12.

The pressurizing roller 14 pressure contacts the separation roller 13 via the fixing belt 11.

The tension roller 16 functions to apply a prescribed amount of tension to the fixing belt 11 with a mechanism having a spring. The amount of applied tension can be 9.8N at one side, and thus is 19.6N at both sides in the fixing mechanism 5.

The heating roller 15 is a hollow cylindrical state made of aluminum or iron, and can include an outer diameter of 35 mm with thickness of about 0.6 mm.

Further, a heat source formed from a heater 15*h*, such as halogen heater, etc., is included to heat the fixing belt 11. The heating roller 15 is arranged not to pressure contact the pressurizing roller 14 inside the fixing belt 11, so that the heat source is not present at the nip N1.

The heat source can employ an induction heating mechanism (IH). Further, a temperature detection sensor 62 is provided to detect temperature of a region where the fixing belt 11 contacts the heating roller 15.

The pressurizing roller 14 is cylindrical state having a core metal made of aluminum or iron and an elastic layer such as silicone rubber, etc., overlying the core metal.

The pressurizing roller 14 includes a hollow core metal having a thickness of 1 mm and Silicone rubber having a thickness of 1.5 mm covering the core metal.

Further coated in a tube state on the silicone rubber as the outermost layer is PFA.

Thus, the diameter of the pressurizing roller 14 may be about 65 mm.

Further, the pressurizing roller 14 includes a heater 14*h*, controlled to turn on and off based on temperature of the pressurizing roller 14, which is detected by a temperature detection sensor 14*s*.

Thus, the pressurizing roller 14 is prevented to absorb heat from a printing member P passing through the nip N1.

Further, on the periphery of the pressurizing roller 14, there is provided a web cleaning unit, not shown, to remove off set toner and paper dust or the like on the roller.

Figure 2:
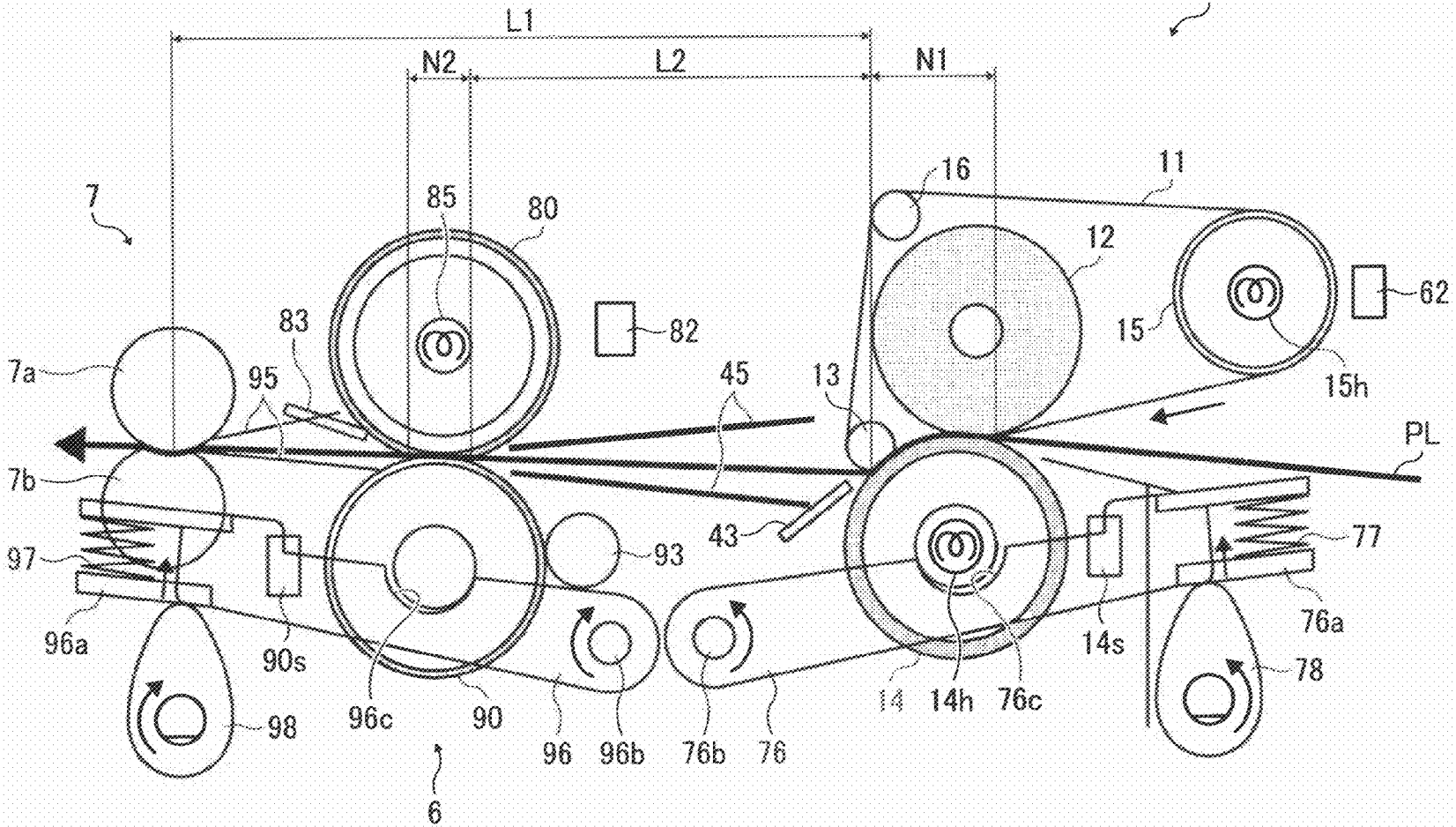
FIG. 2 illustrates an exemplary configuration arranged downstream of a fixing step included in the image forming apparatus according to one embodiment of the present invention.

Further, as shown in FIG. 2, beside the pressurizing roller 14, there are provided a pressurizing device having a pressurizing lever 76, a spring 77, a pressurizing member 76*a*, and a cam 78. Due to the pressurizing device, the pressurizing roller 14 pressure contacts the fixing roller 12 and the separation roller 13 via the fixing belt 11 at various positions depending on a type of the printing member P and a brilliance application or none application mode The pressurizing roller 14 is brought into a pressurizing condition as follows.

When the cam 78 is rotated by a prescribed angle in an arrow showing direction by an external drive force, the pressurizing member 76*a* pushes is lifted up in an arrow showing direction in the drawing.

Then, the spring 77 secured to the pressurizing member 76*a* pushes up the end of the pressurizing lever 76 with a prescribed pressure. Then, the pressurizing lever 76 swings around a support shaft 76*b* counter clockwise in FIG. 2.

Subsequently, a pressurizing section 76*c* located at a middle point between the end of the pressurizing lever 76 on the side of the spring 77 and the support shaft 76*b* engages with a supporting shaft and depresses the pressurizing roller 14 toward the fixing roller 12.

Finally, the pressurizing roller 14 pressure contacts the fixing roller 12 and the separation roller 13 via the fixing belt 11, so that the first and second nips are created by the fixing roller 12 and the pressurizing roller 14, and the separation roller 13 and the pressurizing roller 14, respectively, having a prescribed pressure.

A nip middle region formed therebetween collectively serves as the nip N1 to execute fixing.

The spring 77 can be omitted, and instead, the cam 78 can lifts the end of the pressurizing lever up directly.

At that time, the pressurizing roller 14 bites into the fixing roller 12 via the fixing belt 11 with a prescribed depth such as from 3 to 3.5 mm.

The separation roller 13 comes to be depressed at a prescribed pressure such as 9.8 N at one side against the pressurizing roller 14.

Thus, the nip N1 has a prescribed wide width, such as 35 mm, so that a fixing performance of fixing various sheets become preferable while achieving high speed and high productivity.

The pressurizing roller 14 serves as a driving roller (herein after referred to as a primary drive roller) in the fixing mechanism 5.

The primary drive roller is driven rotated by a drive mechanism, such as a motor, etc., to have a prescribed peripheral speed corresponding to a conveyance speed of a printing member P. It is preferable for the primary drive roller that the elastic layer of the pressurizing roller 14 is thinner than that of the fixing roller 12, because of less variation of temperature of the surface thereof.

When the fixing mechanism 5 is driven, the pressurizing roller 14 is rotates counter clockwise by a motor provided in therein as shown in FIG. 2.

The rotation drive force is transmitted and rotates the fixing roller 12 and the separation roller 13 clockwise in the drawing via a gear.

Thus, the fixing belt 11 receives appropriate tension from the tension roller due to its depression and rotates in a direction to eject the printing member P, i.e., clockwise in FIG. 2.

Further, when a fixing process is executed, the fixing belt 11 is heated up to a prescribed level as a toner fixation completion level, for example, by the heater 15*h* arranged inside the heat roller 15 serving as a driven roller. The temperature detection sensor 62 detects the prescribed level.

Then, the printing member P with the non-fixed toner T is fed through the nip N1 from right to left in the drawing, so that the toner T is fused and fixed onto the printing member P due to heat and pressure at the nip N1.

At that time, the toner is almost fixed in the inlet region (e.g. a first nip region) of the nip N1.

Since the toner sufficiently melts and has intensive adherence performance, the printing member P advances along the nip region sticking to the fixing belt 11.

However, to convey firmly pressing the printing member P avoiding brilliance, the nip pressure preferably ranges from $5N/cm^2$ to $15N/cm^2$ at that time.

The printing member P is then separated from the fixing belt 11 due to intensive separation force caused by curvature of the separation roller 13 having a small diameter.

In addition, the printing member P is separated and ejected by the separation member 43 from the pressurizing roller 14.

Further, a total nipping time period taken by a printing member P to pass through the nip N1 in relation to a line speed is more than 60 msec, while the nip pressure of from 15 to $30N/cm^2$ are provided in more than 50% of the width of the nip when a brilliance application mode is selected.

Thus, sufficient fixing can be obtained in the fixing mechanism 5 even if a thick paper having 300 $g/m^2$ of capacity of scale is used.

Further, by changing a contact condition of the fixing roller 12 and the pressurizing roller 14 in the fixing belt 11, the nip width can be adjusted in the above-mentioned middle region. When a printing member P having less capacity of scale than a plain paper is used, the contact condition of the fixing roller 12 and the pressurizing roller 14, as well as the first, middle, and second nip regions are adjusted to suppress the nip pressure. In this way, when calorie supply increases, such as when a thin paper like a plain paper, etc., is used, the nip pressure is suppressed to reduce or avoid the brilliance.

Thus, in non-brilliance mode of an image forming apparatus as mentioned later, even when a printing member P having a less scale weight than the plain paper that receives excessive calorie is used, image brilliance can be maintained as the thick paper by adjusting the nip width.

Also, in the brilliance application mode, by adjusting the nip width of the first, middle, and second nip regions as well as the nip pressure in the fixing mechanism 5 in accordance with a thickness of the printing member P, image brilliance can ultimately be uniformly obtained.

Thus, desired brilliance can be credibly improved both in the modes.

Nip pressure varies in the nip N1 such that 15 to $30N/cm^2$ are applied to an inlet region thereof as a first nip region where the pressurizing roller 14 contacts the fixing roller 12. The same amount is applied to an outlet region thereof serving as a second nip region where the pressurizing roller 14 contacts the separation roller 13.

Whereas 5 to $15N/cm^2$ is applied to a middle nip region therebetween.

When a brilliance sheet is used, i.e., in a brilliance application mode, the pressurizing device controls the first, middle, and section nip regions to have nip widths of 20 mm, 13 mm, and 2 mm, respectively.

Whereas in a non-brilliance application mode, the pressurizing device controls the first, middle, and section nip regions to have nip widths of 15 mm, 13 mm, and 1 mm, respectively.

Between the fixing mechanism 5 and the brilliance application mechanism 6, there is preferably vertically arranged two sheets of guide plates 45 along the path line narrowing the gap therebetween toward the brilliance application mechanism 6 to guide the sheet ejected and fed thereto from the fixing mechanism 5.

Even though the sheet tends to curl after separation by the curvature of the separation roller 13, the guide plates 45 remove and correct the curl, so that the leading end of the sheet can appropriately direct a correct direction.

Thus, wrinkle and jamming of the sheet can be avoided at the brilliance application mechanism 6, and thereby conveyance quality is improved.

Now, an exemplary conveyance mechanism is described with reference to FIG. 3.

A brilliance application mechanism 6 includes a hollow cylindrical first rotation member (e.g. a heat roller 80) having a heat device (e.g. a heater 85), and a second rotation member (e.g. a pressurizing roller 90) contacting the first rotation member to create a second nip N2 for providing brilliance to an image (i.e., a toner surface) by means of heat and pressure.

Figure 3:
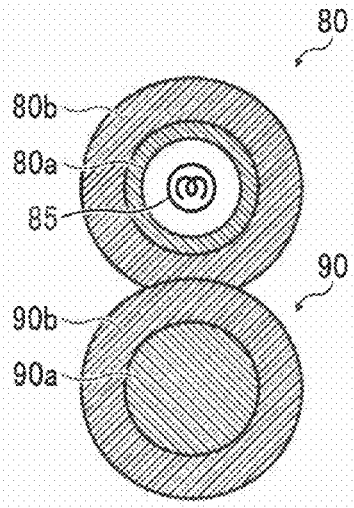
FIG. 3 illustrates an exemplary roller included in a brilliance applying mechanism according to one embodiment of the present invention.

As shown in FIG. 3, the heat roller 80 includes a cylindrical core metal 80*a* made of aluminum or iron, and an elastic layer 80*b* made of silicone or the like overlying the heat roller 80. A heater 85 is included in the core metal 80*a*.

The pressurizing roller 90 includes a round bar core metal 90*a* made of aluminum or iron or the like, and an elastic layer 90*b* made of silicone or the like overlying the pressurizing roller 90.

Since the elastic layer of the pressurizing roller 90 is thinner and accordingly variation of the surface temperature is smaller than that of the heat roller 80, the pressurizing roller 90 serves as a primary drive roller in the brilliance application mechanism 6.

Further, a temperature detection sensor 82 is provided to detect surface temperature of a section of the heat roller 80 adjacent to the entrance of the nip N2.

Thus, the heater 85 such as a halogen heater or the like is controlled to turn on and off based on the temperature detected by the temperature detection sensor 82 to maintain the surface temperature of the heat roller 80 constant.

The surface temperature of the heat roller 80 is controlled to appropriately provide brilliance to fixing toner in the brilliance application mode applying brilliance to an image. For example, the surface temperature of the heat roller 80 contacting the fixing toner on the printing member P is lower than that of the fixing member (e.g. a fixing belt 11) of the fixing mechanism 5.

Otherwise, the surface temperature of the heat roller 80 is preferably more than temperature of a printing member P when the printing member P enters the brilliance application mechanism 6 and less than that right when the printing member P is ejected from the fixing mechanism 5.

Yet otherwise, the surface temperature of the heat roller 80 is preferably more than softening temperature of usage toner detected by a flow tester and less than half outflow start temperature, more preferably more than softening temperature and less than outflow start temperature.

These toner physicality temperatures are preferably obtained based on a relation between temperature and a piston stroke using the flow tester (CFT-500D manufactured by Shimadzu Manufacturing Company Ltd.) on conditions that load is 5 kg/cm$^2$, temperature rising speed is 3.0 degree centigrade/minute, die opening diameter is 1.00 mm, and die length is 10.0 mm.

The above-mentioned half outflow start temperature represents a temperature of a middle point between flow start and complete temperatures.

Specifically, the surface temperature of the heat roller 80 is preferably from 60 to 137 degree centigrade (i.e., softening temperature of physicality temperature of usage toner to half outflow start temperature thereof), more preferably 60 to 120 degree centigrade (i.e., outflow start temperature of the above), and further preferably 60 to 100 degree centigrade. The above-mentioned temperatures are represented by average due to unevenness depending on a toner lot or color.

The non-fixed toner on the printing member P entirely melts from the toner surface onto the printing member P due to heat and pressure at the nip N1 and a fixing process is completed, when the printing member P passes through the fixing mechanism 5 in the image forming apparatus 100.

Further, the toner is leveled by a prescribed amount and tightly contacts the printing member P, thereby creating intensive adherence on the toner surface.

Whereas when passing through the brilliance application mechanism 6 in the brilliance application process, since the fixing process has been completed already, only calorie for leveling the toner surface is provided.

Even though the toner on the printing member P entering the brilliance application mechanism 6 receives the heat and pressure in the nip N2, since the surface temperature of the heat roller 80 is more than temperature of a printing member P when the printing member P enters the brilliance application mechanism 6, and less than that right when the printing member P is ejected from the fixing mechanism 5, or is more than softening temperature of usage toner detected by a flow tester and less than half outflow start temperature, or from 60 to 120 degree centigrade, the toner layer does not entirely melts and only the surface layer thereof is softened.

Thus, the color of the toner is maintained as is, while only the surface layer is leveled by the surface of the smooth heat roller 80, so that the brilliance increases.

At this moment, since the toner surface does not have adherence as in the fixing process, the printing member P credibly separates even if the diameter of the heat roller 80 is more than 30 and less than 40 mm.

Specifically, the separation member 83 arranged on the printing member P ejection side of the brilliance application mechanism 6 can be omitted, so that the apparatus can be simplified saving cost. Further, since offset caused when the toner layer is entirely melted as in the fixing process does not appear, a clean member 93 for removing toner stain on the surface of the pressurizing roller 90 can be omitted. Thus, the apparatus can be simplified saving cost.

Beside the pressurizing roller 90, there is provided a temperature detection sensor 90*s* for detecting temperature of the surface of the pressurizing roller 90.

Further, a pressurizing adjustment device having a pressurizing level 96, a spring 97, a pressurizing member 96*a*, and a cam 98, is provided in the pressurizing roller 90 to bring the pressurizing roller 90 into a pressurizing state when a brilliance application mode is selected as described below.

Specifically, when the cam 98 is rotated by a prescribed angle in an arrow showing direct ion as shown in the drawing by an external drive force, the cam lifts the pressurizing member 96*a* up in an arrow showing direction as shown in the drawing.

Then, the spring 97 secured to the pressurizing member 96*a* pushes up the end of the pressurizing lever 96 with a prescribed pressure. Then, the pressurizing lever 96 swings around a supporting shaft 96*b* clockwise in FIG. 2. Subsequently, a pressurizing section 96*c* located at a middle point between the end of the pressurizing lever 96 on the side of the spring 97 and the supporting shaft 96*b* engages and depresses the shaft of the pressurizing roller 90 toward the heat roller 80. Finally, the pressurizing roller 90 pressure contacts the heat roller 80 with a prescribed pressure and creates the nip N2 for brilliance application use. The spring 97 serving as a pressurizing adjustment device can be omitted, and instead, the cam 98 can directly lift the end of the pressurizing lever 96 up.

Adjustment of pressure executed by the pressurizing adjustment device is controlled by a rotation angle of the cam 98. Thus, at a prescribed angle of the cam 98, the heat roller 80 is separated from the pressurizing roller 90 to open the nip N2.

The nip pressure in the nip N2 is preferably adjusted to be 15 to 30N/cm$^2$ in the brilliance application mode for applying brilliance to an image on the printing member P by the pressure adjustment device.

Thus, when the printing member P conveyed from the fixing mechanism 5 passes through the brilliance application mechanism 6, heat and prescribed pressure are provided to the fixing toner in the nip N2, so that leveling of the surface layer of the fixing toner is executed and brilliance is applied thereto.

Further, when the non-brilliance application mode is chosen and the length of the printing member P is less than 210 mm, the nip pressure in the nip N2 is decreased less than that in the brilliance application mode by the pressurizing adjustment device.

For example, the pressure is preferably adjusted to be less than 15N/cm$^2$, more preferably not more than 5N/cm$^2$.

The nip pressure at that time is the average of the entire nip width as mentioned above.

Thus, even if the printing member P is nipped between the heat and pressurizing rollers 810 and 90, since the nip pressure is weak enough, the brilliance is not provided to the image, so that they simply serve as a conveyance device of the printing member P.

Whereas when the non-brilliance application mode is chosen and the length of the printing member P is more than 210 mm, the nip N2 therebetween is preferably open.

Specifically, in such a mode, a printing member P such as JIS A3 standard sheet having a less basic scale weight than 80 g/m$^2$ is sometimes used as a thin lengthy printing member P. However, fine wrinkle sometimes occurs on the printing member P due to deflection and tension caused by a slight difference of line speed of the printing member P between the fixing mechanism 5 and the brilliance application mechanism 6.

To avoid the problems, the rollers 80 and 90 of the brilliance application mechanism 6 are separated.

When the printing member P simply passes through the brilliance application mechanism 6, since the length thereof is more than 210 mm, the leading end thereof quitting from the nip N1 reaches the conveyance roller pair 7 and is nipped and fed by the same. Thus, the printing member P is precisely conveyed maintaining an image quality while reducing likelihood in that the roller contacts the image formed thereon.

The gap formed between the rollers 80 and 90 is preferably not more than 2 mm.

Because, when the gap is wider than that, the printing member P deviates from the path line PL and likely causes sheet jam.

The respective surfaces of the rollers 80 and 90 are preferably coated with fluorine resin. Because, reliability is improved on one hand.

On the other hand, even when the printing member P is conveyed through the opening of not more than 2 mm in the non-brilliance application mode, and accordingly the image surface partially possibly contacts the heat roller 80, the image is not disturbed due to the reliability of the same.

Hence, with the above-mentioned brilliance application mechanism 6, intended brilliance can be precisely obtained in the brilliance application mode.

Further, both in the brilliance and non-brilliance application modes, credibility of the brilliance is improved.

Further, the mechanism 6 is arranged at a position enabling that the leading end of the printing member P arrives at the nip N2 of the mechanism 6 before the trailing end thereof exits from the nip N1.

For example, the rollers 80 and 90 are arranged so that the distance L2 between the trailing end of the nip N1 and the leading end of the nip N2 is from 60 to 182 mm, preferably 70 to 150 mm, more preferably 80 to 100 mm.

The upper limit of the distance L2 preferably corresponds to the minimum length of the printing member P.

For example, the distance L2 of 182 mm enables a B5 size printing member P (JIS) to be fed in the sheet widthwise direction (i.e., in parallel to its shorter side).

The upper limit of the distance L2 is 150 mm when a half size-printing member P is fed in parallel to its shorter side.

The printing member P either ejected or passing through the mechanism 6 is then fed to the conveyance roller pair 7.

A pair of guide plate members 95 is arranged between the mechanism 6 and conveyance roller pair 7 on the path line PL. A gap therebetween is preferably narrowed as the printing member P advances from the mechanism 6 to conveyance roller pair 7. Specifically, since the guide plates 95 remove and correct curl or the like, so that the leading end of the sheet can appropriately direct a correct direction, wrinkle and jam of the sheet can be avoided at the brilliance application mechanism 6.

Thus, conveyance quality can be stable.

Now, an exemplary conveyance roller pair is described.

A conveyance roller pair 7 includes cylindrical rollers 7*a* and 7*b* each made of chloroprene rubber or silicone rubber and resin, respectively, contacting each other.

One or both of the rollers 7*a* and 7*b* are driven rotated and pinch and further convey the printing member P toward the sheet ejection path.

Even though these rollers 80 and 90 are distanced in the non-brilliance application mode when the length of the printing member P is more than 210 mm in the conveyance direction (corresponding to the shorter length of the JIS A4 printing member P), the printing member P can be credibly conveyed because the conveyance roller pair 7 is arranged within the distance of 210 mm from the trailing end of the nip N1.

Specifically, when the leading end of the printing member P ejected from the nip N1 arrives at the conveyance roller pair 7 before the trailing end thereof exits from the nip N1.

Thus, the printing member P can be appropriately conveyed.

Further, in the mechanism 6, since the temperature of the surface of the heat roller 80 is adjusted to be relatively lower (e.g. higher than that of a printing member P that enters the brilliance application mechanism 6 and lower than that of the same right after being ejected from the fixing mechanism 5, or higher than softening temperature of usage toner detected by a flow tester and lower than half outflow start temperature, yet otherwise from 60 to 120 degree centigrade), the temperature of the printing member P when arriving at the conveyance roller pair 7 is the same or less than that of the same right after being ejected from the fixing mechanism 5 in the brilliance application mode. Thus, toner can be prevented from firmly sticking to the conveyance roller pair 7.

For the same reason, toner can be prevented from firmly sticking to the guide plates 95 or the like.

Figure 4:
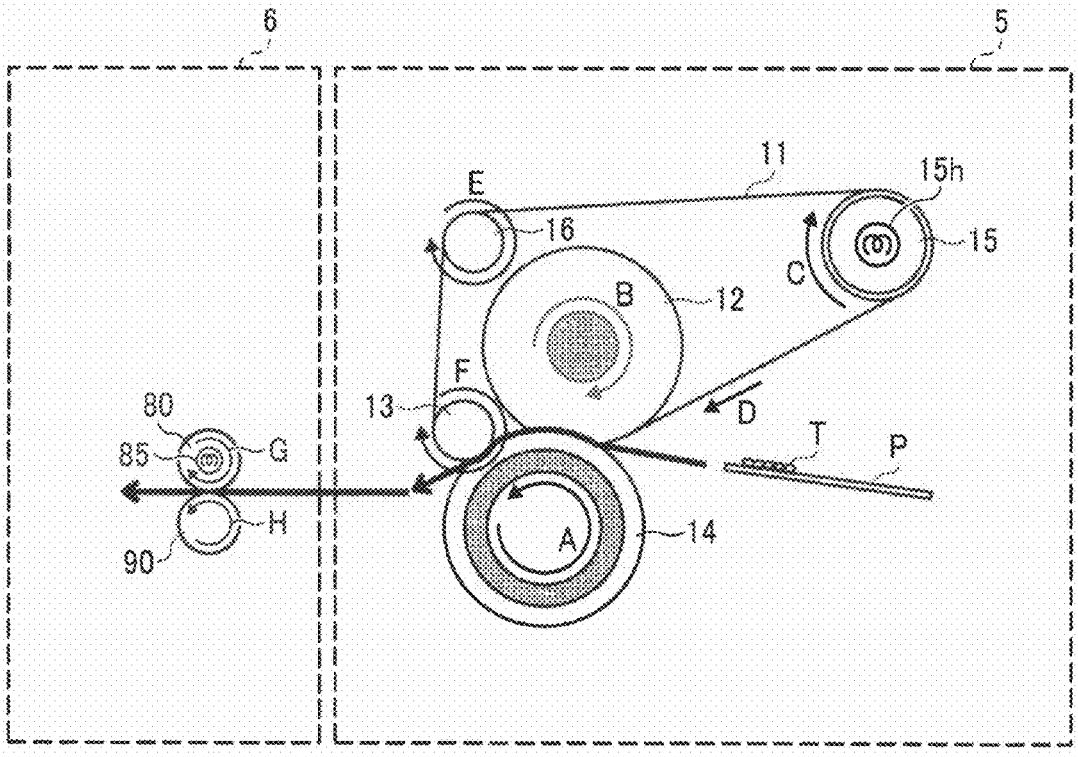
FIG. 4 illustrates an exemplary fixing device according to one embodiment of the present invention.

Now, an exemplary fixing device serving as an essential part of the present invention is described with reference to FIG. 4.

As shown, arrows A to H represent rotation directions when applicable devices rotate in an image formation process of the image forming apparatus 100.

When the image formation process is executed, a printing member P with toner transferred from the secondary transfer section 34 enters the nip N1 of the mechanism 5.

The printing member P ejected from the nip N1 subsequently enters the nip N2 of the mechanism 6.

At this moment, since the leading end of the printing member P arrives at the nip N2 before the trailing end thereof passes through the nip N1, the printing member P is nipped by these two nips N1 and N2 at same time.

The mechanisms 5 and 6 include drive motors mentioned later in detail for driving pressurizing rollers 14 and 90, respectively. These drive motors are independent from the other, and a number of rotations of each of those rollers can be separately designated. Thus, since a conveyance speed of the printing member P becomes different in the mechanisms 5 and 6, and accordingly, a problem sometimes occurs on an image.

When a relation between the printing member conveyance speeds V1 and V2 in the respective mechanisms 5 and 6 meets the following equation and the difference is large, a tension of pulling the printing member P nipped in the mechanism 5 is created at the nip N2.

Whereas, when the conveyance force F1 for conveying the printing member P in the mechanism 5 becomes larger than that in the mechanism 6 (i.e., F1>F2), the printing member P nipped by the mechanism 6 skids.

At that moment, since the elastic layer provided on the surface layer of the brilliance application mechanism 6 has a gripping force, the skid continues intermittently, thereby causing banding or the like on a toner image.

In contrast, when the below-described inequality is established, the sheet becomes loose between the nips N1 and N2 in proportion to a length of the sheet;

$$V1 > V2.$$

As a result, the sheet touches the guide plate 45 and an image is scratched and quality thereof deteriorates.

In the conventional fixing device, conveyance speed control of a printing member P between the mechanisms 5 and 6 is not executed, a difference occurs in a conveyance speed of conveying the printing member P between the mechanisms 5 and 6.

As a result, image deterioration or jam and wrinkle occur between the mechanisms 5 and 6.

Such phenomena necessarily occur even if a number of rotations of each of the primary drive motors of the mechanisms 5 and 6 is controlled to be constant.

Through the investigation of the above-mentioned phenomena, it is revealed that in accordance with changes of the surface temperature of the primary drive rollers of the mechanisms 5 and 6, the surface layer of those expand and shrink so that the outer peripheral diameters change separately.

As a result, a conveyance speed becomes different from the other so that a problem possibly occurs even if a number of rotations of each of the primary drive motors of the mechanisms 5 and 6 is controlled to be constant.

Further, since a diameter of the pressurizing roller 90 is smaller than that of the pressurizing roller 14, the change of the conveyance speed caused by the thermal expansion is larger in the mechanism 6 than that in the mechanism 5.

Further, when the printing member conveyance speed V1 is smaller than that of V2, since a torque of each of the drive motors changes, speed control can be performed based on a prescribed change of performance shown by the motor.

However, when V1 is higher than V2, since none of performance of the drive motor changes, the speed control is impossible based on the change. In view of the above-mentioned investigation, the present invention is made.

Herein below, an exemplary essential part of the present invention is described.

Figure 5:
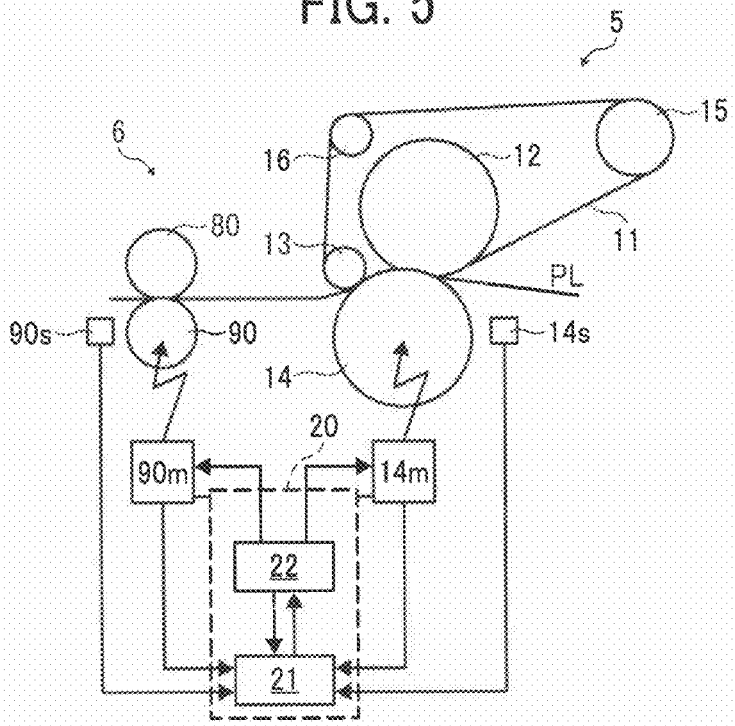
FIG. 5 illustrates exemplary control operation for controlling a conveyance speed of a printing member P in the fixing device according to one embodiment of the present invention.

As shown in FIG. 5, a fixing device of the present invention includes a fixing mechanism 5 having a first motor 14*m*, a first primary drive roller (e.g. a pressurizing roller 14) driven by the first motor 14*m*, and a first nip for fixing non-fixed toner onto a sheet conveyed by rotation of the primary drive roller by heat and pressure.

Also included is a conveyance mechanism (e.g. a brilliance application mechanism 6 having a second motor 90*m* arranged downstream of the fixing mechanism 5, a second primary drive roller (e.g. a pressurizing roller 90) driven by the second motor, and a second nip for pinching and conveying the sheet by rotation of the second primary drive roller.

Yet further included is a motor control section 20 for adjusting a number of rotations of each of the first and second motors 14*m* and 90*m* so that a difference of sheet conveyance speed between the fixing and conveyance mechanisms V1 and V2 changes within a prescribed range.

The motor control section 20 includes a speed difference detection section (21) for detecting a difference between V1 and V2, and a rotation number control section 22 for adjusting a number of rotations of the first and second motors 14*m* and 92*m* to control driving of those.

Further, drive of the first motor 14*m* is conveyed to the pressurizing roller 14 via a drive mechanism, not shown. Drive of the second motor 90*m* is conveyed to the pressurizing roller 90 via a drive mechanism, not shown.

Thus, by adjusting a number of rotations of each of the first and second motors 14*m* and 90*m* using the rotation number control section 22, the conveyance speeds V1 and V2 can be adjusted.

When the speed difference (i.e. V2−V1) is controlled within the prescribed range, the rotation number control section 22 preferably adjusts a number of rotations of the second motor 90*m* rather than that of the first motor 14*m*.

When a relatively long printing member P in the image forming apparatus 100, such as the A3 size (JIS) or the nineteen inch sheet is fed in parallel to its lengthwise side, even one sheet of the printing member P is nipped by both nips of the secondary transfer section 34 and N1.

At this moment, it is not preferable to change a conveyance speed in the mechanism 5, because a transfer step executed in a former stage of a fixing step is affected.

Thus, the rotation number control section 22 controls that of the second motor 90*m*.

Further, so that the below described inequality is met, the rotation number control section 22 more preferably adjusts the number of rotations of one of the first and second motors 14*m* and 90*m;*

$$1.05 \leqq V2/V1 \leqq 1.00. \quad \text{(first formula)}$$

Specifically, when the conveyance speed V1 is higher than that of V2 in the mechanism 5, and thus the below described inequality is established, the printing member P waves and becomes loose between the mechanisms 5 and 6;

$$V2/V1 < 1.00.$$

Whereas when the conveyance speed V2 is excessively higher than that of V1 in the mechanism 5, and thus the below-described inequality is established, the printing member P is intensively expanded between the mechanisms 5 and 6.

As a result, so called rib state wrinkle that obliquely extends on the printing member P from its edge to the center and banding highly likely occur on the image of the printing member P;

$$V2/V1 < 1.05.$$

Then, by adjusting the number of rotations of one of the first and second motors 14*m* and 92*m* with the rotation number control section 22, a conveyance speed in the mechanism 5 or 6 is adjusted, so that the below described inequality is met to improve the problem of loosened and rib wrinkles by appropriately stretching the printing member P in a prescribed direction in the mechanism 6;

$$1.05 \geqq V2/V1 \geqq 1.00.$$

Specifically, by controlling the conveyance speed V2 to be within the +5% of that of V1, preferably +2%, more preferably +1%, the above-mentioned various wrinkles can be prevented or suppressed.

When the number of rotations of one of the first and second motors 14*m* and 92*m* is controlled as mentioned above, current flowing through each of the first and second motors 14*m* and 90*m* is preferably monitored and controlled not to exceed a prescribed reference value.

Otherwise, prescribed relations between conveyance speeds and various conditions of the pressurizing rollers 14 and 90, such as a number of rotations, surface temperature, etc., are previously analyzed, and the rotation number of the motors 14*m* and 90*m* are preferably adjusted based on the relations.

Specifically, the speed difference detection section 21 detects the above-mentioned speed difference based on one of the detection values of current, electric power, and torque of an instruction being provided to each of the motors 14*m* and 90*m*. Otherwise, the speed difference detection section 21 preferably detects the above-mentioned speed difference based on the surface temperature of one or all of the primary drive rollers (e.g. the pressurizing rollers 14 and 90).

Yet otherwise, the speed difference detection section 21 preferably detects the speed difference based on one of the current, electric power, and torque of an instruction, as well as surface temperature of one or all of the primary drive rollers. The above-mentioned current and electric power values are practically put in the motors 14*m* and 90*m* and obtained from the respective controllers of the motors 14*m* and 90*m*, respectively. Further, the torque of the instruction is output from the motor control section 20 to each of the respective controls of the motors 14*m* and 90*m*, and is thus known therefrom.

Figure 6:
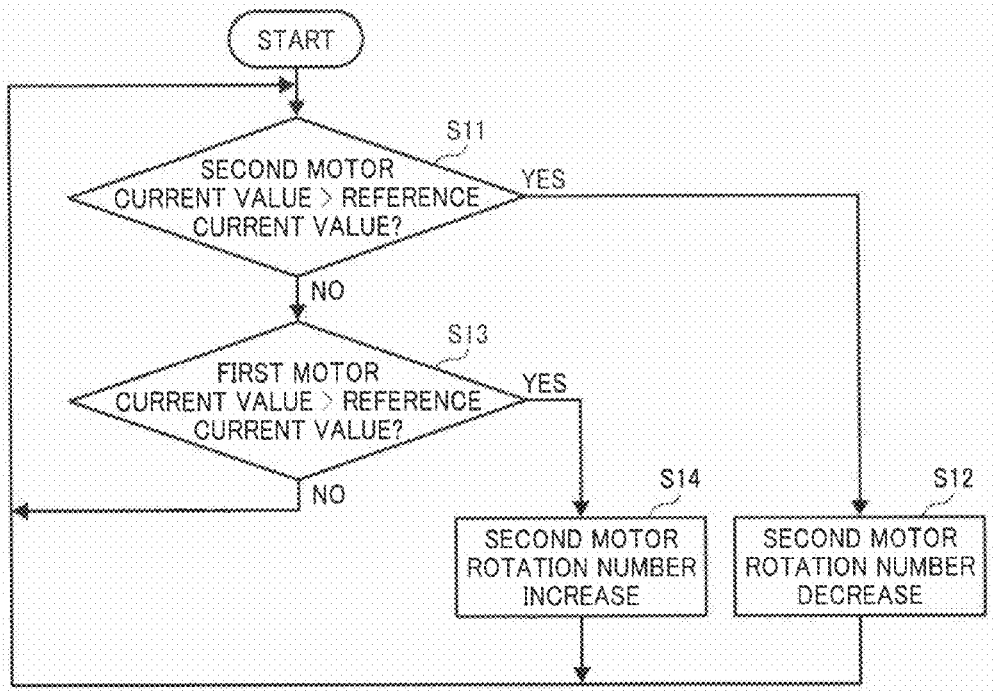
FIG. 6 illustrates the first exemplary control sequence for controlling a conveyance speed of a printing member P executed in the fixing device according to one embodiment of the present invention.

Now, a first exemplary control manner of controlling a printing member conveyance speed in a fixing device according to the present invention are described with reference to FIG. 6, wherein it is premised that motors 14 and 90*m* are controlled by the motor control section 20 to rotate at a prescribed constant number of rotations.

Start with, when a printing member P starts being conveyed, the speed difference detection section 21 obtains a detection value (i.e., a value monitored and detected, hereinafter the same) of a current value $I_2$, and determines if it is larger than a reference current value $Is_2$ on the condition of that number of rotations in step S11.

The reference current value $Is_2$ represents the maximum current value for the second motor 90*m*, which enables the relation between V1 and V2 to meet the following inequality on the condition of that number of rotations;

$$1.05 \geqq V2/V1 \geqq 1.00.$$

When the above-mentioned determination is positive (Yes, in step S11), i.e., the inequality $I_2 > I_{S2}$ is met, the inequality V2>1.05×V1 is established, and thus, load is excessively applied to the second motor 90*m* (i.e., by the amount of the difference of conveyance force: F1−F2), so that a problem, such as banding etc., occurs.

Then, the number of rotations of the second motor 90*m* is decreased and made constant by the rotation number control section 22 to establish the relation of the first formula. Then, the sequence returns to step S11 (in step S12).

Where as when the above-mentioned determination is negative (No, in step S11), i.e., the inequality $I_2 < I_{S2}$ is met, the inequality V2<1.05×V1 is established, the load applied to the second motor 90*m* is constant, and thus the current value does not change, which is generally created by torque load variation.

Then, the speed difference detection section 21 obtains a detection value of a value $I_1$ of current flowing through the first motor 14*m*, and determines if it is larger than a reference current value $I_{S1}$ at the number of rotations in step S13. The reference current value $I_{S1}$ represents the maximum current value for the first motor 14*m*, which enables the relation between V1 and V2 on the condition of that number of rotations to meet the following inequality;

$$1.05 \geqq V2/V1 \geqq 1.00.$$

When the above-mentioned determination is positive (Yes, in step S13), i.e., the inequality $I_1 > I_{S1}$ is met, the inequality V2<V1 is established, and thus, a problem, such as printing member P wrinkle, jam, etc., likely occurs between the mechanisms 5 and 6.

Then, the number of rotations of the second motor 90*m* is increased and made constant by the rotation number control section 22 to establish the relation of the first formula. Then, the sequence returns to step S11 (in step S14).

When the above-mentioned determination is negative (No, in step S13), i.e., the inequality $I_1 \leqq I_{S1}$ is met, it is recognized that the printing member P is normally conveyed, and the sequence returns to step S11 (in step S14).

Thus, due to the above-mentioned control, the problem can be prevented or suppressed and thus the printing member P is appropriately conveyed.

Instead of using the current value, the electric power or the torque of the instruction can be used as the detection value.

Figure 7:
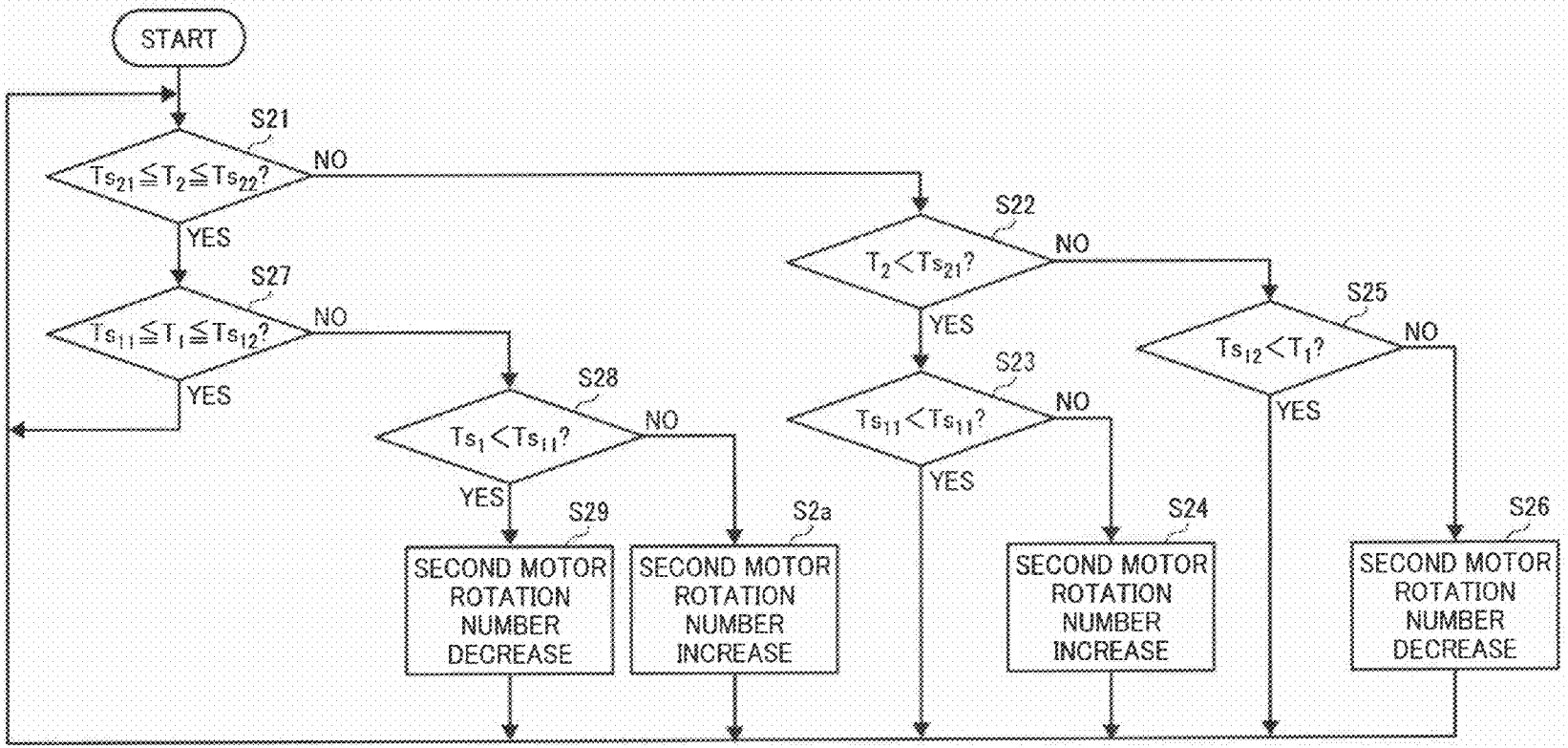
FIG. 7 illustrates the second exemplary control sequence for controlling a conveyance speed of a printing member P executed in the fixing device according to one embodiment of the present invention.

Now, a second exemplary control manner of controlling a printing member conveyance speed in a fixing device according to one embodiment of the present invention is described with reference to FIG. 7, wherein it is again premised that motors 14*m* and 90*m* are controlled by the motor control section 20 to rotate at a prescribed constant number of rotations.

Start with, when a printing member P starts being conveyed, the speed difference detection section 21 obtains a surface temperature T2 of the pressurizing roller 90 as a detection value detected by the temperature detection sensor 90*s*, and determines if it is within a prescribed setting range ($TS_{21} \leqq T_2 \leqq TS_{22}$) capable of obtaining a fine fixing performance on a fixing condition at that time (e.g. a thickness of a sheet) in step S21.

When the above-mentioned determination is negative (No, in step S21), i.e., the value T2 is out of the range, the speed difference detection section 21 determines if the inequality $T_2 < TS_{21}$ is established in step S22.

When the above-mentioned determination is positive (Yes, in step S22), i.e., the inequality $T_2 < TS_{21}$ is met, the speed difference detection section 21 obtains a surface temperature T1 of the pressurizing roller 14 as a detection value detected by the temperature detection sensor 14*s*, and determines if it is lower than a prescribed minimum setting value $T_{S11}$ for the pressurizing roller 14 on the fixing condition at that time in step S23. When it is determined that the inequality T1<$T_{S11}$ is established (Yes, in step S23), the surface temperatures of the respective pressurizing rollers 14 and 90 are less than the prescribed minimum setting values.

It is recognized e that the printing member P is normally conveyed, and the sequence returns to step S21 (in step S23).

Whereas when it is determined that the inequality T1>$T_{S11}$ is established (No, in step S23), it is determined that the surface temperatures of the respective pressurizing rollers 14 and 90 are more and less than the prescribed setting values, respectively, and the inequality V2<V1 is established.

Then, the speed difference detection section 21 increases the number of rotations of the second motor 90*m* and makes it constant to establish the relation of the first formula. Then, the sequence returns to step S21 (in step S24).

Whereas when the above-mentioned determination is negative (No, in step S22), i.e., the inequality $T_2 > TS_{21}$ is met, the speed difference detection section 21 obtains a surface temperature T1 of the pressurizing roller 14 as a detection value detected by the temperature detection sensor 14*s*, and determines if it is higher than a prescribed maximum setting value $T_{S12}$ for the pressurizing roller 14 on the fixing condition at that time in step S25.

When the above-mentioned determination is positive (Yes, in step S25), the surface temperatures of the respective pressurizing rollers 14 and 90 are higher than the prescribed setting values. It is recognized that the temperatures are almost equally high and the printing member P is normally conveyed. Then, the sequence returns to step S21 (in step S25).

When it is determined that the inequality T1≦$T_{S12}$ is established (No, in step S25), it is determined that the surface temperature of the pressurizing roller 14 is less than the prescribed maximum setting value and that of the pressurizing rollers 90 is more than the prescribed setting value, and the inequality V2>1.05×V1 is established.

Then, the number of rotations of the second motor 90*m* is decreased and made constant by the rotation number control section 22 to establish the relation of the first formula. Then, the sequence returns to step S21 (in step S26).

Whereas when the above-mentioned determination is positive (Yes, in step S21), i.e., the value T2 is within the range, the speed difference detection section 21 obtains a surface temperature $T_1$ of the pressurizing roller 14 detected by the temperature detection sensor 14*s*, and determines if it is within a prescribed setting range ($T_{S11} \leqq T_1 \leqq T_{S12}$) on the fixing condition at that time in step S27.

When the above-mentioned determination is positive (Yes, in step S27), i.e., the T1 is within the setting value range, the surface temperatures of the respective pressurizing rollers 14 and 90 are within the prescribed setting values, respectively.

It is thus recognized that the printing member P is normally conveyed and the sequence returns to step S21 (in step S27). Whereas when the above-mentioned determination is negative (No, in step S27), i.e., $T_1$ is without the range, it is determined if the surface temperature $T_1$ is lower than the prescribed minimum setting value $T_{S11}$ for the pressurizing roller 14 in step S28. When the inequality $T_1 < T_{S11}$ is established (Yes, in step S28), it is determined that the surface temperature of the pressurizing rollers 14 is less than the minimum setting value and that of the pressurizing roller 90 is within the prescribed range, and thus the inequality V2>1.05×V1 is established.

Then, the number of rotations of the second motor 90*m* is decreased and made constant by the rotation number control section 22 to establish the relation of the first formula. Then, the sequence returns to step S21 (in step S29).

Whereas when it is determined that the inequality $T1 > T_{S12}$ is established (No, in step S28), it is determined that the surface temperature of the pressurizing rollers 14 is higher than the prescribed maximum setting value and that of the pressurizing rollers 90 is within the prescribed setting value range, and thus the equality V2<V1 is established in step S2*a*.

Then, the number of rotations of the second motor 90*m* is increased and made constant by the rotation number control section 22 to establish the relation of the first formula. Then, the sequence returns to step S21 (in step S2*a*).

Thus, due to the above-mentioned control executed in the mechanisms 5 and 6, the problem can be prevented or suppressed and thus the printing member P is appropriately conveyed.

Figure 8:
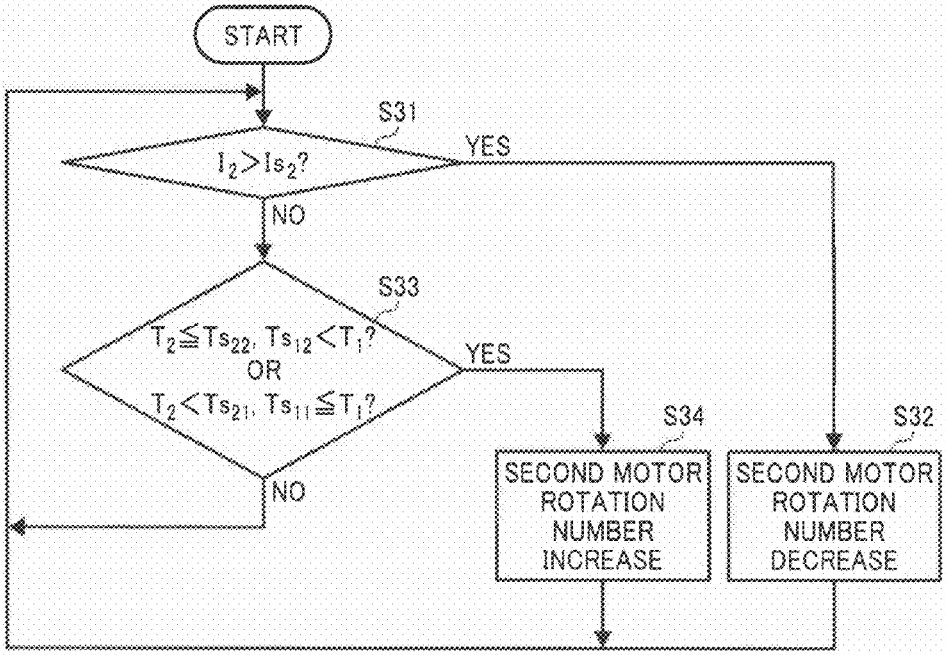
FIG. 8 illustrates the third exemplary control sequence for controlling a conveyance speed of a printing member P executed in the fixing device according to one embodiment of the present invention.

Now, a third exemplary control manner of controlling a printing member conveyance speed in a fixing device according to one embodiment of the present invention is described with reference to FIG. 8, wherein it is again premised that motors 14 and 90*m* are controlled by a motor control section 20 to rotate at a prescribed constant number of rotations.

Start with, when a printing member P starts being conveyed, the speed difference detection section 21 obtains a current value $I_2$ of the second motor 90*m* as a detection value, and determines if it is larger than a prescribed reference current value $Is_2$ for the number of rotations in step S31.

When the above-mentioned determination is positive (Yes, in step S31), i.e., the inequality $I_2 > I_{S2}$ is met, the inequality V2<1.05×V1 is established, and thus a problem, such as banding, etc., likely occurs due to excessive load on the second motor 90*m*.

Then, the number of rotations of the second motor 90*m* is decreased and made constant by the rotation number control section 22 to establish the relation of the first formula. Then, the sequence returns to step S31 (in step S32).

When the above-mentioned determination is negative (No, in step S31), i.e., the inequality $I_2 \leqq I_{S2}$ is met, the inequality V2≦1.05×V1 is established.

At that time, the load on the second motor 90*m* is constant, and thus current value variation caused by torque load variation does not occur.

Then, the speed difference detection section 21 obtains a surface temperature T2 of the pressurizing roller 90 detected by the temperature detection sensor 90*s*, and determines if one of inequalities $T_2 \leqq TS_{22}$, $TS_{12} < T_1$, $T_2 < TS_{21}$, $T_{S11} \leqq T_1$ and $T_2 \leqq TS_{22}$ is met.

When none of them is met (No, in step S33), and it is recognized that the printing member P is normally conveyed, the sequence returns to step S31 (in step S33).

Whereas when the above-mentioned determination is positive (Yes, in step S33), i.e., the inequalities of one of $T_2 \leqq TS_{22}$, $TS_{12} < T_1$, $T_2 < TS_{21}$, $TS_{11} \leqq T_1$, and $T_2 \leqq TS_{22}$ is met, it is determined that the inequality V2<V1 is established.

Then, the number of rotations of the second motor 90*m* is increased and made constant by the rotation number control section 22 to establish the relation of the first formula. Then, the sequence returns to step S31 (in step S34).

Thus, due to the above-mentioned control executed in the mechanisms 5 and 6, the problem can be prevented or suppressed and thus the printing member P is appropriately conveyed.

Now, another exemplary operation of controlling a speed of conveying a printing member P in a fixing device according to one embodiment of the present invention is described with reference to FIG. 9.

As shown, an optical sensor 25 is provided above a conveyance path conveying the printing member P between the mechanisms 5 and 6 (i.e., between the nips N1 and N2).

The configuration of the fixing device is almost the same as described with reference to FIG. 4.

The optical sensor 25 is a non-contact type that measures a distance from the optical sensor 25 to the printing member P. For example, the sensor 25 includes a distance calculation sensor that emits a light (e.g. infrared light) and calculates a distance based on a time period taken from the emission to reception of the reflection light.

Specifically, the optical sensor 25 measures the distance to predict a condition of loosening of a printing member P along the conveyance path.

Further, the optical sensor 25 is preferably arranged at a position where the loosening of the printing member P is maximum between the mechanisms 5 and 6, but is not limited thereto and the other position can be available if it can be recognized that a sheet conveyance speed V1 is higher than that of V2.

Figure 9:
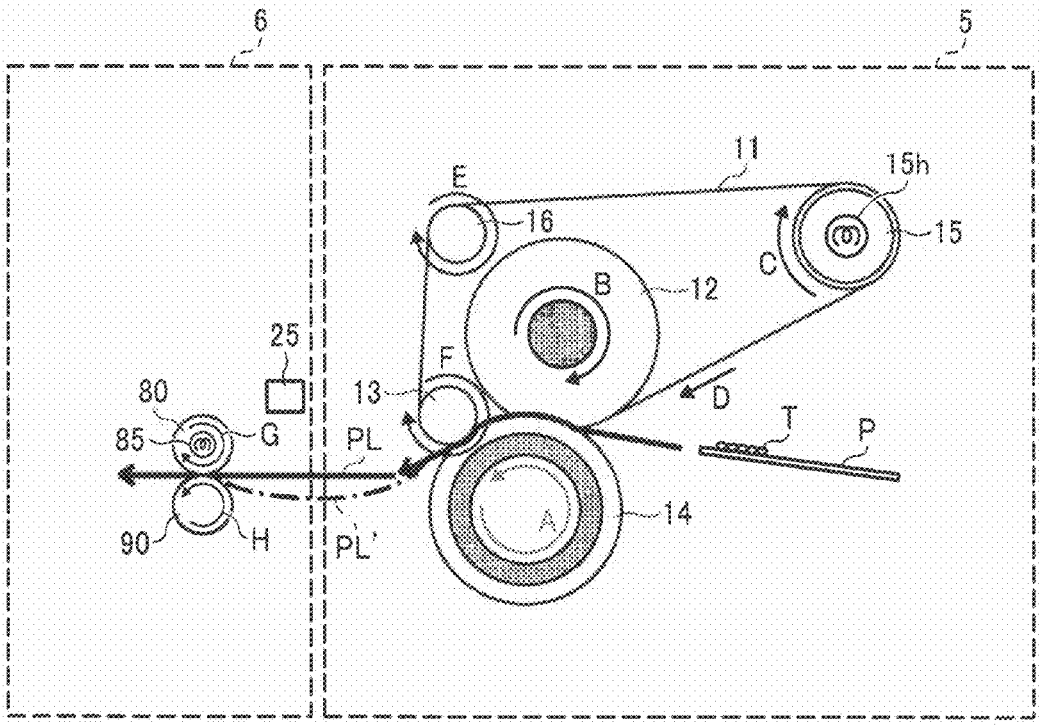
FIG. 9 illustrates another exemplary fixing device according to one embodiment of the present invention.

The loosening condition represents that the inequality V1>V2 is met, and thus, the tension thereof is insufficient or disappears between the mechanisms 5 and 6, and accordingly, the printing member P drops from the path line PL as shown by a dotted line in FIG. 9

Figure 10:
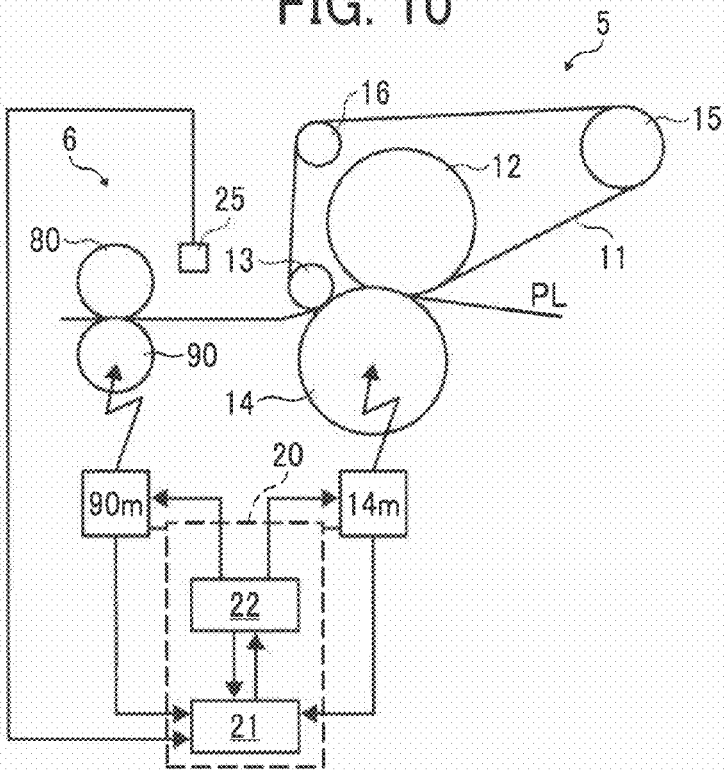
FIG. 10 illustrates another exemplary control sequence for controlling a conveyance speed of a printing member P in the fixing device according to the present invention.

Yet another control manner is described with reference to FIG. 10, where distance information detected by the optical sensor 25 is transmitted to the speed difference detection section 21 instead of temperature detection sensors 14*s* and 90*s*. The remaining sections have almost the same configurations as that in FIG. 5.

The motor control section 20 includes the speed difference detection section 21 that detects a difference of the sheet conveyance speeds V1 and V2, and a rotation number control section 22 that adjusts a number of rotations of each of the first and second motors 14*m* and 90*m* to control driving of those motors 14*m* and 90*m*.

Further, drive of the first motor 14*m* is conveyed to the pressurizing roller 14 via a drive mechanism, not shown.

Drive of the second motor 90*m* is conveyed to the pressurizing roller 90 via a drive mechanism, not shown.

Thus, by adjusting a number of rotations of the first and second motors 14*m* and 90*m* with the rotation number control section 22, the conveyance speeds V1 and V2 can be adjusted.

When the speed difference (i.e. V2−V1) is controlled within the prescribed range, the rotation number control section 22 preferably adjusts a number of rotations of the section motor 90*m* and accordingly the printing member P conveyance speed in the mechanism 6.

When a relatively long printing member P such as the A3 size (JIS), nineteen-inch sheet, etc., is fed in the image forming apparatus 100 in parallel to its lengthwise side, even one sheet of the printing member P is nipped by both of nips (transfer nip) of the secondary transfer section 34 and N1.

At this moment, it is not preferable to change a conveyance speed in the mechanism 5, because a condition of a transfer step executed before a fixing step is affected.

Thus, the rotation number control section 22 controls that of the second motor 90*m*.

Further, the rotation number control section 22 preferably controls the rotation number of one of the first and second motors 14*m* and 90*m* so that the first formula is met.

When the conveyance speed V1 is higher than that of V2, and thus the below described inequality is established, the printing member P waves and becomes loosened between the mechanisms 5 and 6 thereby raising a problem of loosened wrinkle on the printing member P of the image;

$$V2/V1<1.00.$$

Whereas when the conveyance speed V2 is excessively higher than that of V1, and thus the below described inequality is established, the printing member P is intensively expanded between the mechanisms 5 and 6. As a result so-called rib state wrinkle that obliquely extends on the printing member P from its edge to the center and banding highly likely occur on the image on the printing member P;

$$V2/V1<1.05.$$

Then, by adjusting the number of rotations of one of the first and second motors 14*m* and 92*m* with the rotation number control section 22, a conveyance speed is adjusted in the mechanism 5 or 6, so that the below described inequality is met to appropriately stretch the printing member P in a prescribed direction in the mechanism 6 and resolve the problem of loosened and rib wrinkles;

$$1.05\geqq V2/V1\geqq 1.00.$$

Specifically, by controlling the conveyance speed V2 to be within the +5% of that of V1, preferably +2%, motor preferably +1%, the above-mentioned various wrinkles can be prevented or suppressed.

When the number of rotations of one of the first and second motors 14*m* and 92*m* is to be adjusted, respective amounts of current flowing through the first and second motors 14*m* and 90*m* are preferably controlled not to exceed the reference values. Otherwise, prescribed relations between conveyance speeds in the mechanisms 5 and 6, and various conditions of the pressurizing rollers 14 and 90, such as a number of rotations, surface temperature, etc., as well as loosening conditions are previously analyzed, the motors 14*m* and 90*m* can then be adjusted based on the relations.

The speed difference detection section 21 detects the above-mentioned speed difference based on one of the detection values of current, electric power, and torque of an instruction being provided to the motors 14*m* and 90*m* in am manner as mentioned earlier with reference to FIG. 6. The above-mentioned current and electric power values are practically put in the motors 14*m* and 90*m* and obtained from the respective controllers of the motors 14*m* and 90*m*.

Further, the torque of the instruction is output from each of the respective controllers of the motors 14*m* and 90*m* when the instruction of which is provided from the motor control section 20 thereto.

Otherwise, the speed difference detection section 21 detects the difference of the speed based on the loosening condition on the conveyance path between the mechanisms 5 and 6.

Specifically, the speed difference detection section 21 detects the loosening condition on the conveyance path between the mechanisms 5 and 6 and detects the speed difference (V2−V1) based on the distance information detected by the optical sensor 25. More specifically, the speed difference detection section 21 compares distances L0 measured by the optical sensor 25 with a reference value LS0, and detects the loosening condition of the printing member P based on the relation therebetween.

For example, when the inequality L0>LS0 is met, the speed difference detection section 21 determines that a problem, such as loosening, printing member wrinkle, jam, etc., is likely raised by the loosening of the printing member P, and detects the establishment of the inequality V1>V2.

The reference value LS0 represents the maximum value of a distance from the optical sensor 25 to the printing member P when the loosening of the printing member P does not raise a problem between the mechanisms 5 and 6.

Further, the above-mentioned speed difference can be detected based on one of the detected values of current, electric power, and torque of the instruction being provided to the motors 14*m* and 90*m*.

Figure 11:
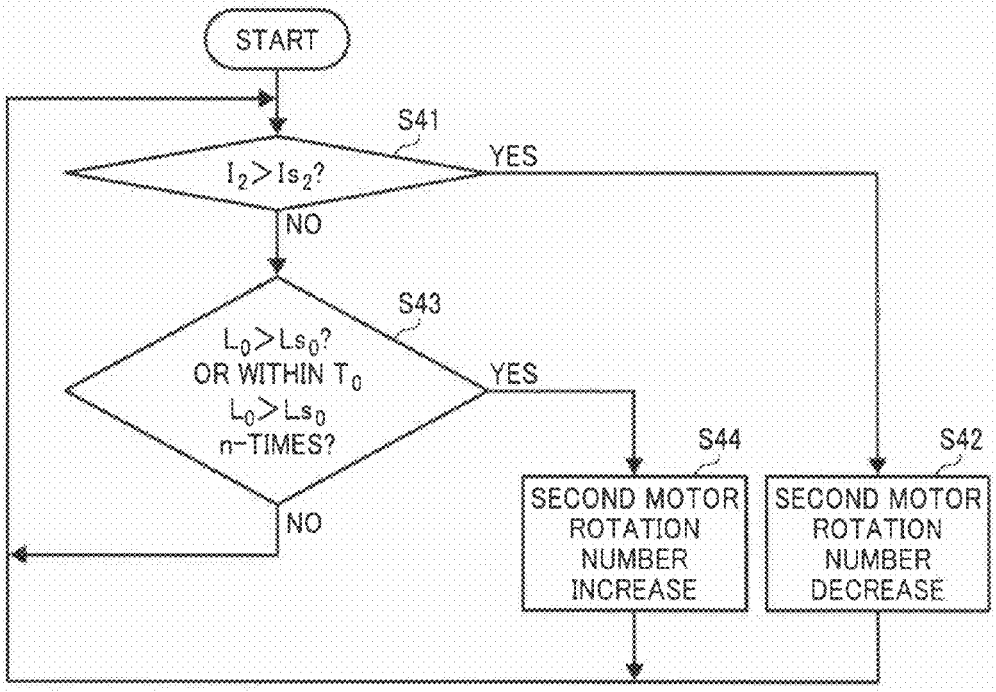
FIG. 11 illustrates the fourth exemplary control sequence for controlling a conveyance speed of a printing member P executed in the fixing device according to the present invention.

Now, a fourth exemplary control manner of controlling a printing member conveyance speed in a fixing device according to one embodiment of the present invention is described with reference to FIGS. 9 to 11, wherein it is again premised that motors 14 and 90*m* are controlled by the motor control section 20 to rotate at a prescribed constant number of rotations.

Start with, when a printing member P starts being conveyed, the speed difference detection section 21 obtains a current value $I_2$ of the second motor 90*m* as a detection value, and determines if it is larger than a prescribed reference current value $Is_2$ with the above-mentioned rotation number in step S41.

When the above-mentioned determination is positive (Yes, in step S41), i.e., the inequality $I_2>I_{S2}$ is met, the inequality V2<1.05×V1 is established, and thus a problem, such as banding, etc., likely occurs due to excessive load on the second motor 90*m*.

Then, the number of rotations of the second motor 90*m* is decreased and made constant by the rotation number control section 22 to establish the relation of the first formula. Then, the sequence returns to step S41 (in step S42).

Whereas when the above-mentioned determination is negative (No, in step S41), i.e., the inequality $I_2\leqq I_{S2}$ is met, the inequality V2≦1.05×V1 is established.

At that time, the load on the second motor 90*m* is constant, and accordingly current value variation caused by torque load change of the second motor 90*m* does not occur.

Then, the speed difference detection section 21 obtains a distance L0 between the optical sensor 25 and the printing member P with the optical sensor 25, and determines if it is larger than the reference distance value LS0 that does not raise the problem between the mechanisms 5 and 6.

When none of them is met (No, in step S43), it is determined that the printing member P is normally conveyed, and the sequence returns to step S31 (in step S43).

Whereas when the above-mentioned determination is positive (Yes, in step S43), i.e., the inequality L0>LS0 is met, it is determined that the inequality V2<1.00×V1 is established.

Then, the number of rotations of the second motor 90*m* is increased and made constant by the rotation number control section 22 to establish the relation of the first formula. Then, the sequence returns to step S41 (in step S44).

Thus, due to the above-mentioned control executed in the mechanisms 5 and 6, the problem can be prevented or suppressed, and thus the printing member P is appropriately conveyed.

Further, since the printing member P on the conveyance is conveyed receiving complex external force, the inequality L0>LS0 is accidentally met and is possibly detected by the optical sensor 25 in step S43.

Then, the inequality V2<1.00×V1 is preferably determined when the inequality L0>LS0 is detected by plural times (e.g. n times) within a prescribed time period T0 in step S43.

Further, the printing member P on conveyance is unstable until its leading end enters the nip N2, and accordingly, the inequality L0>LS0 is also accidentally met and is possibly detected by the optical sensor 25.

Then, a term between when the leading end is detected by the optical sensor 25 and when it enters the nip N2 can be omitted from detection times of the printing member P in step S43

Although downward loosening of the printing member P is mentioned heretofore, it can be loosened upward than the path line PL when the printing member P has high rigidity.

In such a situation, a reference range of a distance from the optical sensor 25 to the printing member P is set from LS1 to LS0 that does not raise the above-mentioned problem between the mechanisms 5 and 6. Then, the speed difference detection section 21 compares a distance L0 detected by the optical sensor 25 with the reference range LS1 to LS0 in step 43 to determine if it is within the range and recognizes the loosening of the printing member P.

For example, when the L0 deviates from the reference range, the speed difference detection section 21 determines that the above-mentioned problem highly probably occurs while detecting the meeting of the inequality V1>V2 in step S44.

Now, brilliance and non-brilliance application modes executed in the image forming apparatus 100 of one embodiment of the present invention are described.

The image forming apparatus 100 includes brilliance and non-brilliance application modes for selectively applying and not applying brilliance to an image on the printing member P. For example, these modes are displayed on a monitor of the image forming apparatus 100 to be optionally selected by a user. In the brilliance application mode, a printing member P having a high brilliance level (e.g. from 30 to 50%), such as a coat sheet, etc., is used and a fixing toner image is formed. Then, the same brilliance as background is applied to the toner image suitable for a graver photograph print use. Whereas in the non-brilliance application mode, a printing member P not having the high brilliance level, such as a plain paper, etc., is used, and an image is formed. However, the brilliance is not applied to the image. The brilliance level represents a value measured by a 60% brilliance scale.

When the brilliance application mode is selected, the below-described process is executed using a coat sheet having the brilliance level of from 30 to 50%, for example, in the similar apparatus as described with reference to FIG. 2.

First, a printing member P with non-fixed toner is conveyed and the toner is already fixed in the mechanism 5 in step 101. At that moment, the fixing belt 11 is heated up to a prescribed level to appropriately fix the toner by the heater 15*h* arranged in the heat roller 15.

The cam 78 as the pressurizing device is controlled to create nip pressure of 15 to 30N/cm$^2$ at 50% of the entire width of the nip N1.

Thus, the toner on the printing member P passing through the mechanism 5 is completely fixed with the brilliance level of more than 25%.

The printing member P ejected out of the mechanism 5 receives correction of its curl or the like from the guide plates 45 and is appropriately conveyed to the mechanism 6 from its leading end in step S102.

In the mechanism 6, brilliance is further applied to the image on the printing member P in step S103.

At that moment, the surface temperature of the heat roller 80 ranges from 80 to 100 degree centigrade.

The pressure adjust device adjusts the nip pressure of the nip N2 to range from 15 to 30N/cm$^2$.

Thus, when the printing member P passes through the mechanism 6, the nip N2 applies a prescribed pressure and heat to the fixing toner, so that the fixed toner surface layer is leveled.

As a result, the brilliance level preferably ranges within ±15%, more preferably within ±10% of that of the printing member P is applied to the fixed toner.

The printing member P ejected out of the mechanism 6 is further ejected via the guide plates 45 and the conveyance roller pair 7 along the conveyance path in step S104.

When the non-brilliance application mode is selected, a size of the printing member P is checked, and the below-described processes are executed in accordance with a determination if the length is more than 210 mm.

Initially, a situation where the length is less than 210 mm is described.

First, a printing member P with non-fixed toner is conveyed and the toner is fixed in the mechanism 5 in step S201.

At that moment, the fixing belt 11 is already heated up to a prescribed level to appropriately fix the toner by the heater 15*h* arranged in the heat roller 15.

The cam 78 as the pressurizing device is controlled to create nip pressure of 15 to 30N/cm$^2$ at 50% of the entire width of the nip N1.

Thus, the toner on the printing member P passing through the mechanism 5 is completely fixed without significantly raising the brilliance level.

Depending on the type of the printing member P, a condition of the mechanism 5 can be the same as in the brilliance application mode.

The printing member P ejected out of the mechanism 5 receives correction of its curl or the like from the guide plates 45 and is appropriately conveyed to the mechanism 6 from its leading end in step S202.

In the mechanism 6, the printing member P is pinched by the nip N2 and is further conveyed in step S203.

At that moment, the surface temperature of the heat roller 80 ranges from 80 to 100 degree centigrade.

However, the pressure-adjusting device adjusts the nip pressure of the nip N2 to be less than that in the brilliance application mode as being less than 5N/cm$^2$, for example.

Thus, when the printing member P passes through the mechanism 6, the nip N2 does not apply significantly large pressure and heat to the fixed toner and provides that with light pressure, so that the brilliance level is not increased.

The printing member P ejected out of the mechanism 6 is further ejected via the guide plates 95 and the conveyance roller pair 7 along the conveyance path in step S204.

Whereas when the length of the printing member P in the printing member P conveyance direction is more than 210 mm, the below mentioned process is executed.

First, a printing member P with non-fixed toner is conveyed and the toner is fixed in the mechanism 5 in step S301.

At that moment, the fixing belt 11 is already heated up to a prescribed level to appropriately fix the toner by the heater 15*h* arranged in the heat roller 15.

The cam 78 as the pressurizing device is controlled to create nip pressure of 15 to 30N/cm$^2$ at 50% of the entire width of the nip N1.

Thus, the toner on the printing member P passing through the mechanism 5 is completely fixed without significantly raising the brilliance level.

The printing member P ejected out of the mechanism 5 receives correction of its curl or the like from the guide plates 45 and is appropriately conveyed to the mechanism 6 from its leading end in step S302.

In the mechanism 6, the printing member P passes through the heat and pressurizing rollers 80 and 90 separated from each other via a roller gap of less than 2 mm.

The printing member P ejected out of the mechanism 6 arrives at the conveyance roller pair 7 via the guide plates 95.

Since the conveyance roller pair 7 is arrange within a distance of less than 210 mm from the trailing end of the nip N1, the leading end of the printing member P arrives at the conveyance roller pair 7 before the trailing end thereof exits from the nip N1. Thus, the printing member P is continuously conveyed by the conveyance roller pair 7, and is finally ejected passing through the conveyance path.

Thus, in the both modes of the different brilliant and printing member length, the image formation is enabled to have desired brilliance without changing the path line PL for the printing member P.

Thus, an image forming apparatus can be downsized.

Further, in the brilliance application mode, the nipping time period can be 30 msec, and is preferably more than 60 msec in the mechanism 5, while that for the mechanism 6 being more than 15 msec. Thus, almost same productivity can be obtained as in the non-brilliance application mode in the brilliance applying mechanism.

Figure 12:
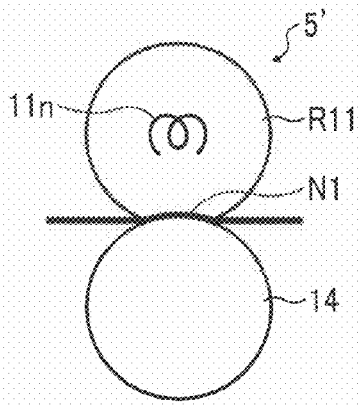
FIG. 12 illustrates another first exemplary configuration of a pressurizing member and a fixing member employed in a fixing mechanism according to the present invention.
Figure 13:
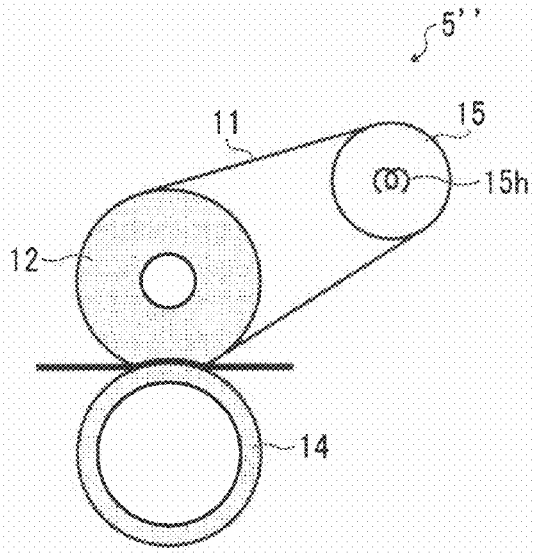
FIG. 13 illustrates another second exemplary configuration of a pressurizing member and a fixing member employed in a fixing mechanism according to the present invention.

Instead of the mechanism 5, mechanisms 5' and 5" as shown in FIGS. 12 and 13 can be employed.

Figure 14:
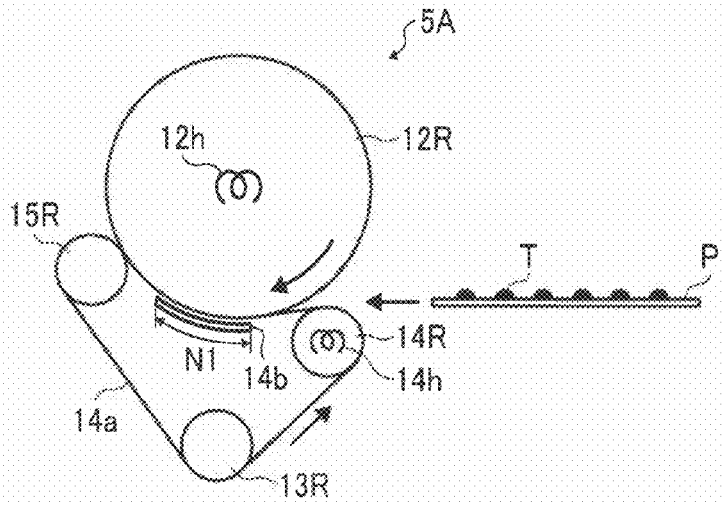
FIG. 14 illustrates another third exemplary configuration of a pressurizing member and a fixing member employed in a fixing mechanism according to the present invention.

Further, a pressurizing belt fixing mechanism can be employed as shown in FIG. 14. Specifically, a pressurizing pad is arranged on a backside of the pressurizing belt as a backup member 14*b* to create the aforementioned fixing nip N1.

Then, pressurizing control is similarly executed to the backup member 14*b* to change the width of the nip N1. The speed V1 and V2 in the mechanisms are similarly controlled as mentioned earlier.

Figure 15:
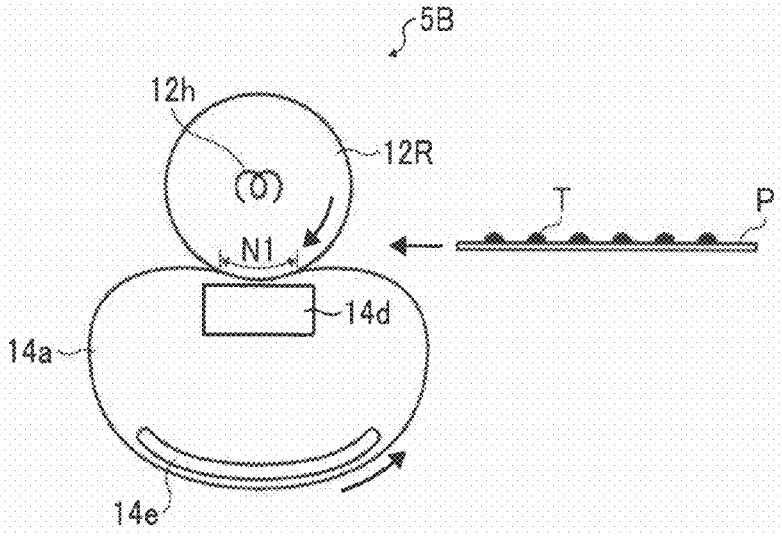
FIG. 15 illustrates another fourth exemplary configuration of a pressurizing member and a fixing member employed in a fixing mechanism according to the present invention.
Figure 16:
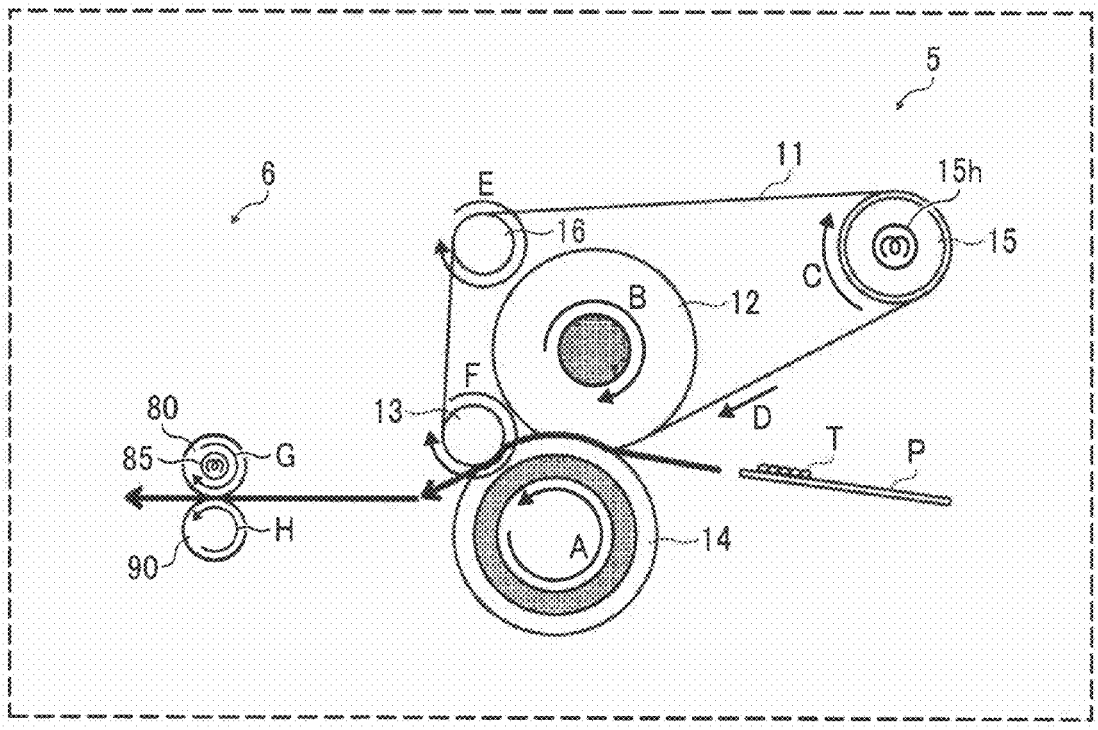
FIG. 16 illustrates yet another exemplary fixing device according to another embodiment of the present invention.

Another fixing mechanism can be employed as shown in FIGS. 15 and 16. Specifically, a tension less pressurizing fixing belt 14*a* and a backup member 14*b* are employed to create the earlier mentioned nips. The backup member 14*b* changes a width of the nip in accordance with the earlier mentioned various modes and printing member types.

Further, instead of the mechanism 6 of FIG. 2, that of FIGS. 13 to 15 can be employed in the system. Further, a mechanism corresponding to that of FIG. 4 can be used.

That is, various combinations can be utilized optionally. Further, the mechanisms 5 and 6 can be either integrated together or separately.

ADVANTAGE

According to one embodiment of the present invention, since a difference of a conveyance speed of a printing member P between a fixing mechanism and a conveyance mechanism is suppressed within a prescribed level, the printing member P can be appropriately conveyed between those nips while preventing jamming wrinkle and image deterioration of the printing member P.

Numerous additional modifications and variations of the present invention are possible in light of the above teachings. It is therefore to be understood that within the scope of the appended claims, the present invention may be practiced otherwise that as specifically described herein.

What is claimed is:

1. A fixing apparatus comprising:

a fixing mechanism including;

a first motor, a first driving roller driven by the first motor pressure contacting a first driven roller, and a first nip formed between the first driving and driven rollers and configured to fix non-fixed toner carried on a sheet conveyed by the first driving roller, a conveyance mechanism arranged downstream of the fixing mechanism including;

a second motor, a second driving roller driven by the second motor contacting a second driven roller, and a second nip formed between the second driving and driven rollers and configured to pinch and convey the sheet as the second driving roller rotates, and a motor control section configured to control sheet conveyance speeds V1 and V2 in the respective fixing and conveyance mechanisms to maintain a difference therebetween within a prescribed range by adjusting a number of rotations of one of the first and second motors.

2. The fixing apparatus as claimed in claim 1, wherein said motor control section adjusts the number of rotations based on one of a value of current flowing to one of the first and second motors, electric power supplied to one of the first and second motors, and a value of torque included in an instruction provided to one of the first and second motors, said value of current, electric power, and value of torque being monitored during an operation of the motor control section.

3. The fixing apparatus as claimed in claim 2, wherein said motor control section adjusts the number of rotations based on surface temperature of one of the first and second driving rollers.

4. The fixing apparatus as claimed in claim 2, wherein said motor control section adjusts the number of rotations based on a loosening amount of the sheet between the fixing and conveyance mechanisms.

5. The fixing apparatus as claimed in claim 4, wherein said conveyance mechanism includes one of a brilliance application section configured to apply brilliance to the sheet and a second fixing section configured to further fix the toner.

6. The fixing apparatus as claimed in claim 4, wherein said second nip is located at a position arrived by the leading end of the sheet before the trailing end of the sheet is ejected out of the first nip.

7. The fixing apparatus as claimed in claim 6, wherein said motor control section adjusts only the number of rotations of the second motor.

8. The fixing apparatus as claimed in claim 6, wherein said motor control section adjusts the number of rotations meeting the following inequality;

$$1.05 \leqq V2/V1 \leqq 1.00.$$

9. The fixing apparatus as claimed in claim 1, further comprising a speed difference detection section configured to detect the difference of the sheet conveyance speed between V1 and V2, wherein said motor control section adjusts the number of rotations based on detection result of the speed difference detection section.

10. The fixing apparatus as claimed in claim 9, wherein said speed difference detection section detects the difference based on one of a value of current flowing to one of the first and second motors, electric power supplied to one of the first and second motors, and a value of torque included in an instruction provided to one of the first and second motors, said value of current, electric power, and value of torque being monitored during an operation of the motor control section.

11. The fixing apparatus as claimed in claim 10, wherein said speed difference detection section detects the difference based on surface temperature of at least one of the first and second driving rollers.

12. The fixing apparatus as claimed in claim 9, wherein said speed difference detection section detects the difference based on a loosening amount of the sheet between the fixing and conveyance mechanisms.

13. The fixing apparatus as claimed in claim 12, further comprising an optical sensor configured to measure a distance from a position of the sensor to the sheet, wherein said speed difference detection section detects the loosening amount based on the distance measure by the optical sensor.

14. The fixing apparatus as claimed in claim 13, wherein said optical sensor is arranged at a position where the loosening amount is largest.

15. The fixing apparatus as claimed in claim 14, wherein said speed difference detection section detects the loosening amount with reference to a prescribed value.

16. The fixing apparatus as claimed in claim 15, wherein said speed difference detection section determines that the inequality V1>V2 is met when the distance detected by the optical sensor is larger than the prescribed value.

17. The fixing apparatus as claimed in claim 15, wherein said motor control section adjusts only the number of rotations of the second motor when said speed difference detection section determines that the inequality V1>V2 is established.

18. The fixing apparatus as claimed in claim 17, wherein said fixing mechanism includes;

a fixing roller, a separation roller, a fixing belt wound around the fixing roller and the separation roller, and a pressurizing roller configured to pressure contact the fixing roller and the separation roller via the fixing belt, said pressurizing roller serving as the driving roller forming the first nip.

19. An image formation system including the fixing apparatus as claimed in claim 18.

20. A method of fixing a toner image, comprising the steps of:

providing a first motor;

providing a first driving roller driven by the first motor;

providing a first nip configured to fix non-fixed toner onto a sheet in a fixing mechanism;

providing a second motor;

providing a second driving roller driven by the second motor;

providing a second nip configured to pinch and convey the sheet as the second driving roller rotates in a conveyance mechanism; and controlling a difference between sheet conveyance speeds V1 and V2 of the sheet fed in the respective fixing and conveyance mechanisms within a prescribe range by adjusting a number of rotations of one of the first and second motors.

* * * * *